US009995439B1

(12) United States Patent
Shum et al.

(10) Patent No.: US 9,995,439 B1
(45) Date of Patent: Jun. 12, 2018

(54) GLARE REDUCED COMPACT LENS FOR HIGH INTENSITY LIGHT SOURCE

(71) Applicant: SORAA, INC., Fremont, CA (US)

(72) Inventors: Frank Tin Chung Shum, Sunnyvale, CA (US); Michael Ragan Krames, Mountain View, CA (US)

(73) Assignee: SORAA, INC., Fremont, CA (US)

( * ) Notice: Subject to any disclaimer, the term of this patent is extended or adjusted under 35 U.S.C. 154(b) by 617 days.

(21) Appl. No.: 14/336,276

(22) Filed: Jul. 21, 2014

Related U.S. Application Data

(63) Continuation-in-part of application No. 13/894,203, filed on May 14, 2013, now Pat. No. 9,360,190, which is a continuation-in-part of application No. 13/865,760, filed on Apr. 18, 2013, now Pat. No. 9,310,052, and a continuation-in-part of application No. 13/909,752, filed on Jun. 4, 2013, now Pat. No. 8,888,332, and a continuation-in-part of application No. 14/014,112, filed on Aug. 29, 2013, now Pat. No. 9,109,760, which is a continuation-in-part of application No. 13/915,432, filed on Jun. 11, 2013.

(60) Provisional application No. 61/707,757, filed on Sep. 28, 2012, provisional application No. 61/646,766, filed on May 14, 2012, provisional application No. 61/776,173, filed on Mar. 11, 2013, provisional application No. 61/655,894, filed on Jun. 5, 2012, provisional application No. 61/659,386, filed on Jun. 13, 2012.

(51) Int. Cl.

| | |
|---|---|
| ***F21K 99/00*** | (2016.01) |
| ***F21V 7/00*** | (2006.01) |
| *F21V 13/04* | (2006.01) |

(52) U.S. Cl.
CPC ..... *F21K 9/54* (2013.01); *F21V 7/0016* (2013.01); *F21V 13/04* (2013.01)

(58) Field of Classification Search
CPC ..... F21K 9/23; F21V 7/0016; F21V 13/04; F21V 29/74
See application file for complete search history.

(56) References Cited

U.S. PATENT DOCUMENTS

| | | | |
|---|---|---|---|
| 2,953,970 | A | 9/1960 | Maynard |
| 3,283,143 | A | 11/1966 | Gosnell |
| 3,593,021 | A | 7/1971 | Auerbach |
| 3,621,233 | A | 11/1971 | Ferdinand et al. |
| 3,874,443 | A | 4/1975 | Bayer, Jr. |
| 4,165,919 | A | 8/1979 | Little |

(Continued)

FOREIGN PATENT DOCUMENTS

| | | |
|---|---|---|
| CN | 1849707 | 10/2006 |
| CN | 2826150 Y | 10/2006 |

(Continued)

OTHER PUBLICATIONS

USPTO Notice of Allowance for U.S. Appl. No. 13/274,489 dated Sep. 30, 2014 (7 pages).

(Continued)

*Primary Examiner* — Anabel Ton

(57) ABSTRACT

Compact reflective lens for a high intensity light emitting diode light sources having improved output beam characteristics are disclosed. The reflective lenses can be configured to increase output intensity, control output light characteristics, and reduce glare.

10 Claims, 16 Drawing Sheets

(56) References Cited

U.S. PATENT DOCUMENTS 4,225,904 A 9/1980 Linder
4,279,463 A 7/1981 Little
4,293,892 A 10/1981 Plummer
5,005,109 A 4/1991 Carleton
5,764,674 A 6/1998 Hibbs-Brenner et al.
6,116,758 A 9/2000 Lin
6,204,602 B1 3/2001 Yang et al.
6,501,154 B2 12/2002 Morita et al.
D471,881 S 3/2003 Hegde
6,787,999 B2 9/2004 Stimac et al.
6,864,572 B2 3/2005 Lee et al.
6,889,006 B2 5/2005 Kobayashi
6,942,368 B1 9/2005 Kane et al.
6,964,877 B2 11/2005 Chen et al.
7,207,694 B1 4/2007 Petrick
D545,457 S 6/2007 Chen
7,311,417 B1 12/2007 Lemke
7,318,659 B2 1/2008 Robling et al.
7,344,279 B2 3/2008 Mueller et al.
7,388,751 B2 6/2008 Hood et al.
7,431,071 B2 10/2008 Wenger
D581,583 S 11/2008 Peng
7,458,706 B1 12/2008 Liu et al.
7,488,097 B2 2/2009 Reisenauer et al.
7,506,998 B2 3/2009 Ansems et al.
D592,613 S 5/2009 Plonski et al.
7,631,987 B2 12/2009 Wei
7,637,635 B2 12/2009 Xiao et al.
7,658,528 B2 2/2010 Hoelen et al.
7,663,229 B2 2/2010 Lu et al.
7,674,015 B2 3/2010 Chien
7,712,922 B2 5/2010 Hacker et al.
D618,634 S 6/2010 Lin et al.
7,744,259 B2 6/2010 Walczak et al.
D619,551 S 7/2010 Lin et al.
7,748,870 B2 7/2010 Chang et al.
7,753,107 B2 7/2010 Zhou et al.
7,800,119 B2 9/2010 He et al.
7,824,075 B2 11/2010 Maxik
7,824,077 B2 11/2010 Chen et al.
7,889,421 B2 2/2011 Narendran et al.
7,972,040 B2 7/2011 Li et al.
7,993,025 B2 8/2011 Chiu
7,993,031 B2 8/2011 Grajcar
7,997,774 B2 8/2011 Liddle
8,042,969 B2 10/2011 Paik et al.
8,049,122 B2 11/2011 Watford
D652,564 S 1/2012 Maxik
8,153,475 B1 4/2012 Shum et al.
8,157,422 B2 4/2012 Paik et al.
8,164,237 B2 4/2012 Wen
8,206,015 B2 6/2012 Cho et al.
D662,899 S 7/2012 Shum et al.
D662,900 S 7/2012 Shum et al.
8,215,800 B2 7/2012 Plank
8,220,970 B1 7/2012 Khazi et al.
8,227,962 B1 7/2012 Su
8,242,669 B2 8/2012 Qiu
8,272,762 B2 9/2012 Maxik et al.
8,324,835 B2 12/2012 Shum et al.
D674,960 S 1/2013 Chen et al.
8,390,207 B2 3/2013 Dowling et al.
8,405,947 B1 3/2013 Green et al.
8,414,151 B2 4/2013 Allen et al.
8,525,396 B2 9/2013 Shum et al.
8,567,999 B2 10/2013 Paik et al.
8,579,470 B1 11/2013 Leahy et al.
D694,722 S 12/2013 Shum et al.
8,618,742 B2 12/2013 Shum et al.
8,643,257 B2 2/2014 Shum et al.
8,651,711 B2 2/2014 Rudisill et al.
8,680,787 B2 3/2014 Veskovic
8,746,918 B1 6/2014 Rubino
8,752,975 B2 6/2014 Rubino
8,803,452 B2 8/2014 Shum et al.
8,829,774 B1 9/2014 Shum et al.
8,884,501 B2 11/2014 Cho et al.
8,884,517 B1 11/2014 Shum et al.
8,888,332 B2 11/2014 Martis et al.
2001/0021073 A1 9/2001 Leggo et al.
2002/0014535 A1 2/2002 Okada et al.
2002/0119702 A1 8/2002 Chen et al.
2003/0039122 A1 2/2003 Cao
2003/0058650 A1 3/2003 Shih
2003/0107885 A1 6/2003 Galli
2003/0183835 A1 10/2003 Moku et al.
2003/0197807 A1 10/2003 Wu et al.
2004/0222427 A1 11/2004 Hsiung
2004/0264195 A1 12/2004 Chang et al.
2005/0122690 A1 6/2005 Hood et al.
2005/0174780 A1 8/2005 Park
2005/0214992 A1 9/2005 Chakraborty et al.
2006/0028310 A1 2/2006 Asano et al.
2006/0175045 A1 8/2006 Chen
2006/0202851 A1 9/2006 Cash et al.
2006/0208091 A1 9/2006 Nishizawa et al.
2006/0262545 A1 11/2006 Piepgras et al.
2006/0274529 A1 12/2006 Cao
2007/0007898 A1 1/2007 Bruning
2007/0158797 A1 7/2007 Lee
2007/0228999 A1 10/2007 Kit
2007/0284564 A1 12/2007 Biwa et al.
2008/0002444 A1 1/2008 Shekhawat et al.
2008/0049399 A1 2/2008 Lu et al.
2008/0080137 A1 4/2008 Otsuki et al.
2008/0123341 A1 5/2008 Chiu
2008/0142781 A1 6/2008 Lee
2008/0158887 A1 7/2008 Zhu et al.
2008/0164489 A1 7/2008 Schmidt et al.
2008/0266866 A1 10/2008 Tsai
2008/0272714 A1 11/2008 Noble et al.
2008/0315228 A1 12/2008 Krames et al.
2009/0027878 A1 1/2009 Metz et al.
2009/0072252 A1 3/2009 Son et al.
2009/0134421 A1 5/2009 Negley
2009/0154166 A1 6/2009 Zhang et al.
2009/0161356 A1 6/2009 Negley et al.
2009/0175043 A1 7/2009 Frick
2009/0194252 A1 8/2009 Lee et al.
2009/0195186 A1 8/2009 Guest et al.
2009/0231895 A1 9/2009 Hu
2009/0237940 A1 9/2009 Wu et al.
2009/0244899 A1 10/2009 Chyn
2009/0303738 A1 12/2009 Suss et al.
2009/0303762 A1 12/2009 Jang et al.
2010/0060130 A1 3/2010 Li
2010/0061076 A1 3/2010 Mandy et al.
2010/0066266 A1 3/2010 Huang et al.
2010/0091487 A1 4/2010 Shin
2010/0118148 A1 5/2010 Lee et al.
2010/0148145 A1 6/2010 Ishibashi et al.
2010/0207502 A1 8/2010 Cao et al.
2010/0207534 A1 8/2010 Dowling et al.
2010/0244648 A1 9/2010 Yoo
2010/0264799 A1 10/2010 Liu et al.
2010/0277068 A1 11/2010 Broitzman
2010/0290229 A1 11/2010 Meyer, Sr. et al.
2010/0320499 A1 12/2010 Catalano et al.
2011/0018418 A1 1/2011 Yoo
2011/0032708 A1 2/2011 Johnston et al.
2011/0056429 A1 3/2011 Raring et al.
2011/0074270 A1 3/2011 Van De Ven et al.
2011/0095686 A1 4/2011 Falicoff et al.
2011/0140586 A1 6/2011 Wang
2011/0169406 A1 7/2011 Weekamp et al.
2011/0175510 A1 7/2011 Rains, Jr. et al.
2011/0175528 A1 7/2011 Rains, Jr. et al.
2011/0182065 A1 7/2011 Negley et al.
2011/0198979 A1 8/2011 Shum et al.
2011/0204763 A1 8/2011 Shum et al.
2011/0204779 A1 8/2011 Shum et al.
2011/0204780 A1 8/2011 Shum et al.
2011/0215699 A1 9/2011 Le et al.
2011/0242823 A1 10/2011 Tracy et al.

(56) References Cited

U.S. PATENT DOCUMENTS

| | | | | |
|---|---|---|---|---|
| 2011/0260945 | A1 | 10/2011 | Karasawa | |
| 2011/0298371 | A1 | 12/2011 | Brandes et al. | |
| 2011/0309734 | A1 | 12/2011 | Lin et al. | |
| 2012/0018754 | A1 | 1/2012 | Lowes | |
| 2012/0043552 | A1 | 2/2012 | David et al. | |
| 2012/0043913 | A1 | 2/2012 | Melanson | |
| 2012/0161626 | A1 | 6/2012 | van de Ven et al. | |
| 2012/0187830 | A1 | 7/2012 | Shum et al. | |
| 2012/0212960 | A1 | 8/2012 | Rodriguez | |
| 2012/0293062 | A1 | 11/2012 | Pickard | |
| 2012/0314403 | A1 | 12/2012 | Kennedy et al. | |
| 2012/0319148 | A1 | 12/2012 | Donofrio et al. | |
| 2012/0320579 | A1 | 12/2012 | Ferguson et al. | |
| 2013/0058099 | A1 | 3/2013 | Shum et al. | |
| 2013/0121390 | A1 | 5/2013 | Chang et al. | |
| 2013/0322089 | A1 | 12/2013 | Martis et al. | |
| 2013/0343062 | A1 | 12/2013 | Shum et al. | |
| 2014/0028214 | A1 | 1/2014 | Mazumdar et al. | |
| 2014/0091697 | A1 | 4/2014 | Shum | |
| 2014/0146545 | A1 | 5/2014 | Shum et al. | |
| 2014/0175966 | A1 | 6/2014 | Tan | |
| 2014/0268750 | A1* | 9/2014 | Lui | F21S 8/061 362/235 |
| 2014/0313749 | A1 | 10/2014 | Shum et al. | |

FOREIGN PATENT DOCUMENTS

| | | |
|---|---|---|
| CN | 2009-75612 | 11/2007 |
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2005-302483 | 10/2009 |
| JP | 2011-501351 | 1/2011 |
| TW | M425985 U | 4/2012 |
| WO | WO 2009/048956 | 3/2009 |
| WO | WO 2009/149263 | 12/2009 |
| WO | WO 2009/156969 | 12/2009 |
| WO | WO 2011/054716 | 5/2011 |

OTHER PUBLICATIONS

USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 14/014,112 dated Nov. 19, 2014 (24 pages).
USPTO Office Action for U.S. Appl. No. 14/054,597 dated Dec. 5, 2014 (9 pages).
USPTO Office Action for U.S. Appl. No. 14/075,936 dated Sep. 24, 2014 (7 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).
Tyagi et al., 'Partial Strain relaxation via misfit dislocation generation at heterointerfaces in (Al,In)GaN epitaxial layers grown on semipolar (1122) GaN free standing substrates', Applied Physics Letters 95, (2009) pp. 251905.
Communication from the Chinese Patent Office re 2011800543977 dated Jan. 7, 2015 (13 pages).
USPTO Office Action for U.S. Appl. No. 13/480,767 dated Dec. 18, 2014 (17 pages).
USPTO Office Action for U.S. Appl. No. 13/855,423 dated Mar. 17, 2015 (22 pages).
USPTO Notice of Allowance for U.S. Appl. No. 29/441,108 dated Mar. 13, 2015 (7 pages).
USPTO Notice of Allowance for U.S. Appl. No. 29/469,709 dated Feb. 6, 2015 (5 pages).
Haskell et al., 'Defect Reduction in (1100) m-plane gallium nitride via lateral epitaxial overgrowth by hydride vapor phase epitaxy', Applied Physics Letters 86, 111917 (2005), pp. 1-3.
Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.
International Preliminary Report & Written Opinion of PCT Application No. PCT/US2011/060030 dated Mar. 21, 2012, 11 pgs. total.
CFL Ballast IC Drive LED, www.placardshop.com, Blog, May 22, 2012, 3 pgs.
Thermal Properties of Plastic Materials', Professional Plastics, Aug. 21, 2010, pp. 1-4.
Rausch, 'Use a CFL ballast to drive LEDs', EDN Network, 2007, pp. 1-2.
Communication from the Japanese Patent Office re 2013532993 dated Jul. 9, 2014 (5 pages).
Communication from the Japanese Patent Office re 2012191931, dated Oct. 11, 2013 (4 pages).
Communication from the Chinese Patent Office re 201210322687.1 dated Mar. 3, 2014, (8 pages).
USPTO Office Action for U.S. Appl. No. 12/785,953 dated Apr. 12, 2012 (11 pages).
USPTO Office Action for U.S. Appl. No. 12/785,953 dated Jan. 11, 2013 (14 pages).
USPTO Office Action for U.S. Appl. No. 13/025,791 dated Nov. 25, 2011 (11 pages).
USPTO Office Action for U.S. Appl. No. 13/025,791 dated Feb. 20, 2013 (13 pages).
USPTO Notice of Allowance for U.S. Appl. No. 13/025,791 dated Jun. 17, 2013 (8 pages).
USPTO Office Action for U.S. Appl. No. 13/025,833 dated Dec. 14, 2011 (10 pages).
USPTO Office Action for U.S. Appl. No. 13/025,833 dated Jul. 12, 2012 (15 pages).
USPTO Office Action for U.S. Appl. No. 13/025,833 dated Apr. 26, 2013 (22 pages).
USPTO Notice of Allowance for U.S. Appl. No. 13/025,833 dated Oct. 11, 2013 (11 pages).
USPTO Office Action for U.S. Appl. No. 13/025,849 dated Mar. 15, 2013 (17 pages).
USPTO Notice of Allowance for U.S. Appl. No. 13/025,849 dated Sep. 16, 2013 (10 pages).
USPTO Office Action for U.S. Appl. No. 13/025,860 dated Dec. 30, 2011 (14 pages).
USPTO Notice of Allowance for U.S. Appl. No. 13/025,860 dated Jun. 8, 2012 (9 pages).
USPTO Office Action for U.S. Appl. No. 13/269,193 dated Oct. 3, 2013 (12 pages).
USPTO Notice of Allowance for U.S. Appl. No. 13/269,193 dated Mar. 31, 2014 (8 pages).
USPTO Office Action for U.S. Appl. No. 13/274,489 dated Sep. 6, 2013 (12 pages).
USPTO Office Action for U.S. Appl. No. 13/274,489 dated Mar. 27, 2014 (14 pages).
USPTO Office Action for U.S. Appl. No. 13/480,767 dated Oct. 25, 2013 (28 pages).
USPTO Office Action for U.S. Appl. No. 13/480,767 dated Apr. 29, 2014 (21 pages).
USPTO Office Action for U.S. Appl. No. 13/535,142 dated Aug. 1, 2013 (13 pages).
USPTO Office Action for U.S. Appl. No. 13/535,142 dated Nov. 14, 2013 (23 pages).
USPTO Office Action for U.S. Appl. No. 13/535,142 dated Feb. 25, 2014 (23 pages).
USPTO Office Action for U.S. Appl. No. 13/959,422 dated Oct. 8, 2013 (10 pages).
USPTO Notice of Allowance for U.S. Appl. No. 13/959,422 dated Jul. 9, 2014 (7 pages).
USPTO Notice of Allowance for U.S. Appl. No. 29/399,523 dated Mar. 5, 2012 (7 pages).

(56) References Cited

OTHER PUBLICATIONS

USPTO Notice of Allowance for U.S. Appl. No. 29/399,524 dated Mar. 2, 2012 (8 pages).
USPTO Notice of Allowance for U.S. Appl. No. 29/423,725 dated Jul. 19, 2013 (9 pages).

* cited by examiner

GLARE REDUCED COMPACT LENS FOR HIGH INTENSITY LIGHT SOURCE

This application is a continuation-in-part of U.S. application Ser. No. 13/894,203 filed on May 14, 2013, which is a continuation-in-part of U.S. application Ser. No. 13/865,760 filed on Apr. 18, 2013, which claims benefit under 35 U.S.C. § 119(e) to U.S. Provisional Application No. 61/707,757 filed on Sep. 28, 2012, and U.S. application Ser. No. 13/894,203 claims the benefit under 35 U.S.C. § 119(e) to U.S. Provisional Application No. 61/646,766 filed on May 14, 2012; and this application is a continuation-in-part of U.S. application Ser. No. 13/909,752 filed on Jun. 4, 2013, which claims benefit under 35 U.S.C. § 119(e) to U.S. Provisional Application No. 61/776,173 filed on Mar. 11, 2013, and to U.S. Provisional Application No. 61/655,894 filed on Jun. 5, 2012; and this application is a continuation-in-part of U.S. application Ser. No. 14/014,112 filed on Aug. 29, 2013, which is a continuation-in-part of U.S. application Ser. No. 13/915,432 filed on Jun. 11, 2013, which claims benefit under 35 U.S.C. § 119(e) to U.S. Application No. 61/659,386 filed on Jun. 13, 2012, each of which is incorporated by reference in its entirety.

FIELD

The present invention relates to lighting. More specifically, embodiments of the present invention relate to a compact optic lens for a high intensity light source having improved output beam characteristics. Some general goals include, increasing light output without increasing device cost or device size to enable coverage of many beam angles.

BACKGROUND

The present invention relates to lighting. More specifically, the present invention relates to a compact optic lens for a high intensity light source.

The era of the Edison vacuum light bulb will be coming to an end soon. In many countries and in many states, common incandescent bulbs are becoming illegal, and more efficient lighting sources are being mandated. Some of the alternative light sources currently include fluorescent tubes, halogen, and light emitting diodes (LEDs). Despite the availability and improved efficiencies of these other options, many people have still been reluctant to switch to these alternative light sources.

There are several key reasons why consumers have been slow to adopt the newer technologies. One such reason is the use of toxic substances in the lighting sources. As an example, fluorescent lighting sources typically rely upon mercury in a vapor form to produce light. Because the mercury vapor is considered a hazardous material, spent lamps cannot simply be disposed of at the curbside but must be transported to designated hazardous waste disposal sites. Additionally, some fluorescent tube manufacturers go so far as to instruct the consumer to avoid using the bulb in more sensitive areas of the house such as in bedrooms, kitchens, and the like.

The inventors of the present invention also believe that another reason for the slow adoption of alternative lighting sources is the low performance compared to the incandescent light bulb. As an example, fluorescent lighting sources often rely on a separate starter or ballast mechanism to initiate the illumination. Because of this, fluorescent lights sometimes do not turn on "instantaneously" as consumers expect and demand. Further, fluorescent lights typically do not immediately provide light at full brightness, but typically ramp up to full brightness within an amount of time (e.g., 30 seconds). Further, most fluorescent lights are fragile, are not capable of dimming, have ballast transformers that can emit annoying audible noise, and can fail in a shortened period of time if cycled on and off frequently. Because of this, fluorescent lights do not have the performance consumers require.

Another type of alternative lighting source more recently introduced relies on the use of light emitting diodes (LEDs). LEDs have advantages over fluorescent lights including the robustness and reliability inherent in solid state devices, the lack of toxic chemicals that can be released during accidental breakage or disposal, instant-on capabilities, dimmability, and the lack of audible noise. The inventors of the present invention believe, however, that current LED lighting sources themselves have significant drawbacks that cause consumers to be reluctant to using them.

A key drawback with current LED lighting sources is that the light output (e.g., lumens) is relatively low. Although current LED lighting sources draw a significantly lower amount of power than their incandescent equivalents (e.g., 5-10 watts v. 50 watts), they are believed to be far too dim to be used as primary lighting sources. As an example, a typical 5 watt LED lamp in the MR16 form factor may provide 200-300 lumens, whereas a typical 50 watt incandescent bulb in the same form factor may provide 700-1000 lumens. As a result, current LEDs are often used only for exterior accent lighting, closets, basements, sheds or other small spaces.

Another drawback with current LED lighting sources includes an upfront cost that is often shockingly high to consumers. For example, for floodlights, a current 30 watt equivalent LED bulb may retail for over $60, whereas a typical incandescent floodlight may retail for $12. Although the consumer may rationally "make up the difference" over the lifetime of the LED by the LED consuming less power, the inventors believe the significantly higher prices greatly suppress consumer demand. Because of this, current LED lighting sources do not have the price or performance that consumers expect and demand.

Additional drawbacks with current LED lighting sources include that they have many parts and are labor intensive to produce. As an example, one manufacturer of an MR16 LED lighting source utilizes over 14 components (excluding electronic chips), and another manufacturer of an MR 16 LED lighting source utilizes over 60 components. The inventors of the present invention believe that these manufacturing and testing processes are more complicated and more time consuming, compared to manufacturing and testing of a LED device with fewer parts and using a more modular manufacturing process.

Additional drawbacks with current LED lighting sources are that the output performance is limited by the heat sink volume. More specifically, the inventors believe that for replacement LED light sources, such as MR16 light sources, current heat sinks are incapable of dissipating much of the heat generated by the LEDs under natural convection. In many applications, the LED lamps are placed into an enclosure such as a recessed ceiling that already experiences ambient air temperatures over 50 degrees C. At such temperatures the emissivity of surfaces plays only a small role in dissipating the heat. Furthermore, because conventional electronic assembly techniques and LED reliability factors limit PCB board temperatures to about 85 degrees C., the power output of the LEDs is also greatly constrained. At higher temperatures, radiation can play a much more important role, and as a result high emissivity heat sink surfaces are desirable.

Traditionally, light output from LED lighting sources has been enhanced simply by increasing the number of LEDs, which has led to increased device costs, and increased device size. Additionally, such lights have had limited beam angles and limited outputs due to limitations on the dimensions of reflectors and other optics.

Embodiments of the present disclosure use certain lighting-related terms, which are now defined.

Beam light angle refers to the angle where light intensity of a light source drops to about 50% of the maximum intensity. For example, a light source with a maximum or central beam intensity of 2000 candle power will have a beam angle defined by where the light intensity drops to about 1000 candle power.

Field angle refers to the angle where the light intensity of the light source drops to about 10% of the maximum or central beam intensity. For example, a light source with a maximum or central beam intensity of 2000 candle power will have an associated field angle within which the light intensity drops to about 200 candle power.

Direct glare associated with a light source refers to light provided by a light source within a region outside the field angle or outside 30 degrees off-axis, that is brighter than a specified percentage of the maximum output of the light source (e.g., about 0.1%). In the prior art, light output from the central portion of reflective lenses has been proposed in a variety of ways that did not provide acceptable results. For example, in U.S. Pat. No. 5,757,557 and in U.S. Pat. No. 6,896,381, the reflective lens includes a centrally located transmissive lens that disperses light directly from the high intensity center region of a light source. Drawbacks with such approaches include that the reflected light from the reflective portion of the lens and the directly transmitted light from the central portion of the lens produce two distinct light beams. When the two different light beams do not overlap, a dark gap is apparent and the output light is also undesirably non-uniform. When the two different light beams overlap, a hot spot is apparent and the output light is also undesirably non-uniform. These solutions also do not contemplate glare and do not even ways to reduce glare.

In another prior art example, U.S. Pat. No. 8,238,050, the reflective lens includes a central reflector that reflects high intensity light back to a main reflector. The main reflector then reflects the light outward from the cap. Drawbacks with such approaches include that the deliberately reflected light may not be constrained such that the light output is undesirably non-uniform. In other examples, such as disclosed in U.S. Pat. No. 6,896,381, and in U.S. Pat. No. 6,473,554, the front lens is configured to not require a central reflector. The same drawback exists with this approach because reflected light from a central region is of high intensity and contrasts with the absence of directly transmitted light from the central region. As a result, the light output is undesirably non-uniform. Additionally, these solutions do not contemplate glare and do not address ways to reduce glare.

In other prior art examples, methods for reducing glare have included recessing a light source deep within a cylindrical or conical collar. Such solutions physically reduce glare by reducing the beam angle and/or field angle, similar to "barn doors" used in stage lighting. Drawbacks to such approaches include that the lighting assembly requires a deep recess housing. Such solutions cannot fit within standardized lighting physical formats and thus are not suitable for the intended purposes of a compact light source.

Accordingly, what is desired is a highly efficient lighting source without the drawbacks described above.

SUMMARY

Embodiments of the present invention utilize a monolithically formed optical lens having multiple regions that modify and direct light from the high intensity light source toward an output. In some embodiments, the output beam angle, beam shape, beam transitions (e.g., falloff), and other attributes of the light are at least in part determined by physical characteristics of the monolithically formed optical lens.

According to one aspect of the invention, a compact optic lens for a high intensity light source is described. One device includes a molded transparent body having a light receiving region, a light reflecting region, a light blending region, and a light output region. In various embodiments, the light receiving region comprises a first geometric structure within the transparent body that is configured to receive input light from the high intensity light source within a plurality of first two-dimensional planes, and is configured to provide a first output light within the first two-dimensional planes within the transparent body to a light reflecting region.

In some embodiments, the light reflecting region comprises a surface on the transparent body that is configured to receive the first output light from the light receiving region, and is configured to provide a second output light within the plurality of first two-dimensional planes within the transparent body to the light blending region. In some embodiments, the light blending region comprises a plurality of prism structures formed on the transparent body that is configured to receive the second output light from the light reflecting region, wherein the plurality of prism structures is configured to optically deflect the second output light to form a deflected output light within a plurality of second two-dimensional planes, and wherein the plurality of prism structures is configured to provide the deflected output light as blended light within the transparent body to the light output region. In some embodiments, the plurality of first two-dimensional planes and the plurality of second two-dimensional planes intersect, and the light output region comprises the surface on the transparent body that is configured to receive the blended light and to output the blended light.

According to certain aspects, a method for blending light rays from a light source within a optic lens including a light receiving region, a light reflecting region, a light blending region, and a light output region is described. One technique includes receiving in the light receiving region, a first light ray associated with a first two-dimensional plane from the high intensity light source and providing a first output light ray to the light reflecting region, and a second light ray associated with a second two-dimensional plane from the high intensity light source and providing a second output light ray to the light reflecting region, wherein the first two-dimensional plane and the second two-dimensional plane are not parallel. One process includes receiving in the light reflecting region the first output light ray from the light receiving region and providing a third light ray associated with the first two-dimensional plane to the light blending region, and the second output light ray from the light receiving region and providing a fourth light ray associated with the second two-dimensional plane to the light blending region. A method includes receiving in a plurality of prismatic structures, the third light ray from the light reflecting region and providing a fifth light ray associated with a third two-dimensional plane to the light output region, and the fourth light ray from the light reflecting region and providing a sixth light ray associated with a fourth two-dimensional plane to the light output region, wherein the first two-dimensional plane and the third two-dimensional plane are not parallel, and wherein the second two-dimensional plane and the fourth two-dimensional plane are not parallel. A method includes receiving at a specific location on the light output region, the fifth light ray and the sixth light ray, and outputting blended light in response to the fifth light ray and the sixth light ray.

According to certain aspects, an illumination source configured to output blended light is described. One illumination source includes an LED light unit configured to provide non-uniform light output in response to an output driving voltage, and a driving module coupled to the LED light unit, wherein the driving module is configured to receive an input driving voltage and is configured to provide the output driving voltage. A lamp includes a heat sink coupled to the LED light unit, wherein the heat sink is configured to dissipate heat produced by the LED light unit and by the driving module, and a reflector coupled to the heat sink, wherein the reflector is configured to receive the non-uniform light output, and wherein the reflector is configured to output a light beam having reduced non-uniform light output.

In various embodiments of the present invention, a central portion of the lens is covered with one or more opaque, light attenuating, diffusing or translucent materials that serve as a glare blocker or glare cap. In certain embodiments, a glare cap is embodied as a round metal disc and cap, which can be inset or attached to the center region of the lens. In various embodiments, the glare cap is magnetizible (e.g., includes iron, nickel, or the like), or comprises a magnet. In various embodiments, a round lens filter, or the like, also includes a magnet or a metal central region that attaches to the glare cap.

Glare caps provided by the present disclosure for the lighting assembly can effectively reduce undesirable glare while increasing the maximum center beam intensity, or center beam candle power (CBCP) of a lighting assembly. In various embodiments, a ratio of the intensity of light within a glare range (e.g., from about 30 degrees to about 60 degrees) compared to the maximum center beam intensity is constrained to be within a range of about 1:1000 to about 1:3000. A glare cap placed within a central region of a lens provides this capability. In some embodiments, a ratio of a diameter of the glare cap to the diameter of the lens is on the order of about 1:2.5 to about 1:4.5.

According to certain aspects, a light source is disclosed. One device includes a light assembly comprising a plurality of LED light sources configured to output light, and a heat sink coupled to the light assembly configured to dissipate heat generated by the light assembly. An apparatus may include a lens assembly coupled to the heat sink and the light assembly, wherein the lens assembly is configured to receive light from the plurality of LED light sources, wherein the lens assembly is configured to output light within a beam angle characterized by a maximum beam intensity, wherein the lens assembly is configured to output light within a glare angle characterized by a maximum glare intensity, wherein the glare angle is within a range of about 30 degrees to about 60 degrees, and wherein a ratio of the maximum glare intensity compared to the maximum beam intensity is within a range of about 1:1000 to about 1:5,000.

Reference is now made to certain embodiments of optics for LED-based lamps and methods of using such optics. The disclosed embodiments are not intended to be limiting of the claims. To the contrary, the claims are intended to cover all alternatives, modifications, and equivalents.

BRIEF DESCRIPTION OF THE DRAWINGS

A person skilled in the art will understand that the drawings, described herein, are for illustration purposes only. The drawings are not intended to limit the scope provided by the present disclosure.

DETAILED DESCRIPTION

For typical single LED lighting assemblies and multiple LED lighting assemblies, the output light beam is non-spatially uniform. For instance, the output light beams of many current LED light sources have hot-spots, dark-spots, roll-offs, rings, and the like. Such non-uniformities can be unattractive and unacceptable for use in many if not most lighting applications. To address these issues, lighting sources that have reduced non-uniform output light beams are provided. Additionally, reflective lenses capable of receiving non-uniform input light beams, and transmitting output light beams with reduced non-uniformity are provided. In some embodiments, an output light beam of a reflective lens may have increased non-uniformity in output light beams, by specific design, e.g., a light ring pattern.

Figure 1:
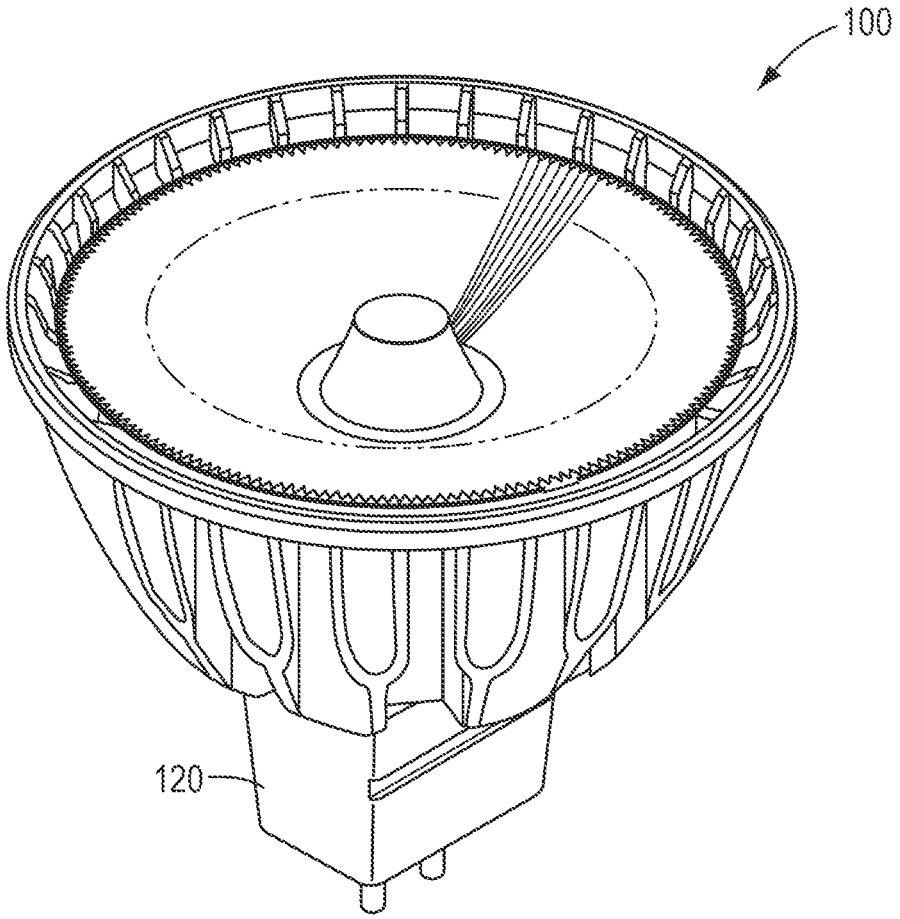
FIG. 1 and FIG. 2 show an MR16 compatible LED lighting source according to certain embodiments.
Figure 2:
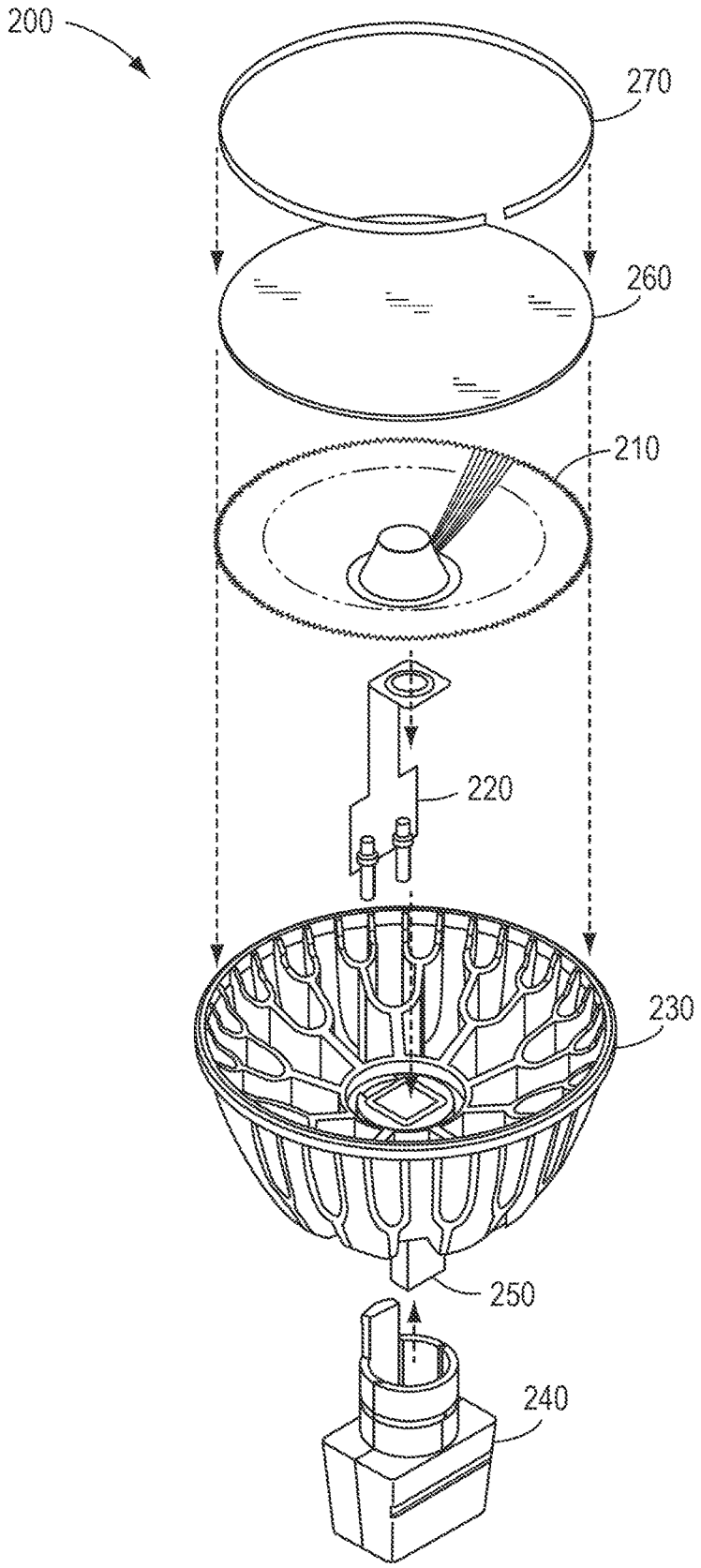

FIG. 1 illustrates an embodiment of the present invention. More specifically, FIG. 1 and FIG. 2 illustrate embodiments (e.g., in an MR-16 form factor) of an MR-16 light source compatible LED lighting source 100 having a GU 5.3 form factor compatible base 120. MR-16 lighting sources typically operate upon 12 volts, alternating current (e.g., VAC). In the examples, LED lighting source 100 can be configured to provide a spotlight having approximately a 10 degree beam size. In other embodiments LED lighting sources may be configured to provide a flood light having a 25 degree or a 40 degree beam size, or any other lighting pattern.

In various embodiments, any suitable LED assembly may be used within LED lighting source 100. Examples of suitable LED assemblies are disclosed in U.S. Application Publication No. 2012/0255872, U.S. Application Publication No. 2013/0322089, U.S. Application Publication No. 2013/0343062, U.S. application Ser. No. 13/915,432 filed on Jun. 11, 2013, U.S. application Ser. No. 13/894,203 filed on May 14, 2013, and U.S. application Ser. No. 13/865,760 filed on Apr. 18, 2013, each of which is incorporated by reference in its entirety. These LED assemblies are currently under development by the assignee of the present patent application. In various embodiments, LED lighting source 100 may provide a peak output brightness of approximately 7600 candelas to 8600 candelas (with approximately 360 lumens to 400 lumens), a peak output brightness of approximately 1050 candelas to 1400 candelas for a 40 degree flood light (with approximately 510 lumens to 650 lumens), and a peak output of approximately 2300 candelas to 2500 candelas for a 25 degree flood light (with approximately 620 lumens to 670 lumens), and the like. Various embodiments of the present invention therefore are believed to have achieved the same brightness as conventional halogen bulb MR-16 lights.

FIG. 2 shows an exploded view of various embodiments of the present invention. As shown in FIG. 2 lamp 200 includes a reflecting lens 210, an integrated LED module/assembly 220, a heat sink 230, a base housing 240, a transmissive optical lens (e.g., transmissive lens 260, optional), and a retainer 270. In various embodiments, a modular approach to assembling lamp 200 is believed to reduce the manufacturing complexity, reduce manufacturing costs, and increase the reliability of such lamps.

In various embodiments, reflective lens 210 and transmissive lens 260 may be formed from a UV and thermally resistant transparent material, such as glass, polycarbonate material, or the like. In various embodiments, reflecting lens 210 and/or transmissive lens 260 may be clear and transmissive or solid or coated and reflective. In the case of reflecting lens 210, a solid material can create a folded light path such that light that is generated by the integrated LED assembly 220 internally reflects within reflecting lens 210 more than one time prior to being output. Such a folded optic lens enables light from the lamp to have a tighter columniation than is normally available from a conventional reflector of equivalent depth. For transmissive lens 260, the solid material may be clear or tinted, may be machined or molded, or the like to control the output characteristics of the light from lens 210.

In various embodiments, to increase durability of the lamps, the optical materials should be continuously operable at an elevated temperature (e.g., 120 degrees C.) for a prolonged period of time (e.g., hours). One material that may be used for lens 210 is known as Makrolon™ LED 2045 or LED 2245 polycarbonate available from Bayer Material Science AG. In other embodiments, other similar materials may also be used.

In FIG. 2, lens 210 may be secured to heat sink 230 via one or more indentations or heat dissipation fins on heat sink 230, or the like. In addition, lens 210 may also be secured via an adhesive proximate to where integrated LED assembly 220 is secured to heat sink 230. In various embodiments, separate clips may be used to restrain lens 210. These clips may be formed of heat resistant plastic material that can be white colored to reflect backward scattered light back through the lens.

In some embodiments, transmissive lens 260 may be secured to heat sink 230 via the clips described above. Alternatively, transmissive lens 260 may first be secured to a retaining ring 270, and retaining ring 270 may be secured to one or more indents of heat sink 230. In some embodiments, once transmissive lens 260 and a retaining mechanism (e.g., retaining ring 270) is secured to lens 210 or to heat sink 230, they cannot be removed by hand. In such cases, one or more tools can be used to separate these components. In other embodiments, these components may be removed from lens 210 or from heat sink 230 simply by hand.

In various embodiments of the present invention, LED assemblies may be binned based upon lumen per watt efficacy. For example, in some examples, an integrated LED module/assembly having a lumen per watt (L/W) efficacy from 53 L/W to 66 L/W may be binned for use for 40 degree flood lights, a LED assembly having an efficacy of approximately 60 L/W may be binned for use for spot lights, a LED assembly having an efficacy of approximately 63 L/W to 67 L/W may be used for 25 degree flood lights, and the like. In various embodiments, other classification or categorization of LED assemblies on the basis of L/W efficacy may be used for other target applications.

In some embodiments, as will be illustrated below, integrated LED assembly/module 220 includes 36 LEDs arranged in series, in parallel series (e.g., three parallel strings of 12 LEDs in series), or the like. In other embodiments, any number of LEDs may be used, e.g., 1, 10, 16, or the like. In other embodiments, the LEDs may be electrically coupled in other manner, e.g., all series, or the like. Further details concerning such LED assemblies are provided in the documents incorporated by reference.

In various embodiments, the targeted power consumption for LED assemblies is less than 13 watts. This is much less than the typical power consumption of halogen-based MR16 lights (50 watts). Accordingly, embodiments of the present invention are able to match the brightness or intensity of halogen based MR16 lights, but using less than 20% of the energy.

In various embodiments of the present invention, LED assembly 220 can be directly secured to heat sink 230 to dissipate heat from the light output portion and/or from the electrical driving circuits. In some embodiments, heat sink 230 may include a protrusion portion 250 to be coupled to electrical driving circuits. LED assembly 220 can include a flat substrate such as silicon or the like. In various embodiments, an operating temperature of LED assembly 220 may be from 125 degrees C. to 140 degrees C. In such embodiments, the silicon substrate can be secured to the heat sink using a thermally conductive epoxy (e.g., thermal conductivity ~96 W/m·k.). In some embodiments, a thermoplastic/thermoset epoxy may be used such as TS-369, TS-3332-LD, or the like, available from Tanaka Kikinzoku Kogyo K.K. Other epoxies may also be used. In some embodiments, no screws are otherwise used to secure the LED assembly to the heat sink; however, screws or other fasteners may also be used in other embodiments.

In various embodiments, heat sink 230 may be formed from a material having a low thermal resistance and high thermal conductivity. In some embodiments, heat sink 230 may be formed from an anodized 6061-T6 aluminum alloy having a thermal conductivity k=167 W/m·k., and a thermal emissivity e=0.7. In some embodiments, other materials may be used such as 6063-T6 or 1050 aluminum alloy having a thermal conductivity, k=225 W/m·k. and a thermal emissivity, e=0.9. In some embodiments, still other alloys such AL 1100, or the like may be used. Additional coatings may also be added to increase thermal emissivity, for example, paint provided by ZYP Coatings, Inc. utilizing $Cr_2O_3$ or $CeO_2$ may provide a thermal emissivity, e=0.9; coatings provided by Materials Technologies Corporation under the brand name Duracon™ may provide a thermal emissivitye>0.98; and the like. In other embodiments, heat sink 230 may include other metals such as copper, or the like.

In some embodiments, at an ambient temperature of 50 degrees C., and in free natural convection heat sink 230 has been measured to have a thermal resistance of approximately 8.5 degrees C./Watt, and in certain embodiments, heat sink 230 has been measured to have a thermal resistance of approximately 7.5 degrees C./Watt. In certain embodiments, heat sink 230 can have a thermal resistance as low as 6.6 degrees/Watt In various embodiments, base assembly/module 240 in FIG. 2 provides a standard GU 5.3 physical and electronic interface to a light socket. A cavity within base module 240 includes high temperature resistant electronic circuitry used to drive LED module 220. In various embodiments, an input voltage of 12 VAC to the lamps are converted to 120 VAC, 40 VAC, or other voltage by the LED driving circuitry. The driving voltage may be set depending upon a specific LED configuration (e.g., series, parallel/series, etc.) desired. In various embodiments, protrusion portion 250 extends within the cavity of base module 240.

The shell of base assembly 240 may be formed from an aluminum alloy, and may be formed from an alloy similar to that used for heat sink 230 and/or heat sink 290. In one example, an alloy such as AL 1100 may be used. In other embodiments, high temperature plastic material may be used. In some embodiments, instead of being separate units, base assembly 240 may be monolithically formed with heat sink 230.

As illustrated in FIG. 2, a portion of the LED assembly 220 (silicon substrate of the LED device) contacts heat sink 230 in a recess within the heat sink 230. Additionally, another portion of the LED assembly 220 (containing the LED driving circuitry) is bent downwards and is inserted into an internal cavity of base module 240.

In various embodiments, to facilitate a transfer of heat from the LED driving circuitry to the shell of the base assemblies, and of heat from the silicon substrate of the LED device, a potting compound is provided. The potting compound may be applied in a single step to the internal cavity of base assembly 240 and to the recess within heat sink 230. In various embodiments, a compliant potting compound such as Omegabond® 200 available from Omega Engineering, Inc. or 50-1225 from Epoxies, Etc. may be used. In other embodiments, other types of heat transfer materials may be used.

Figure 3:
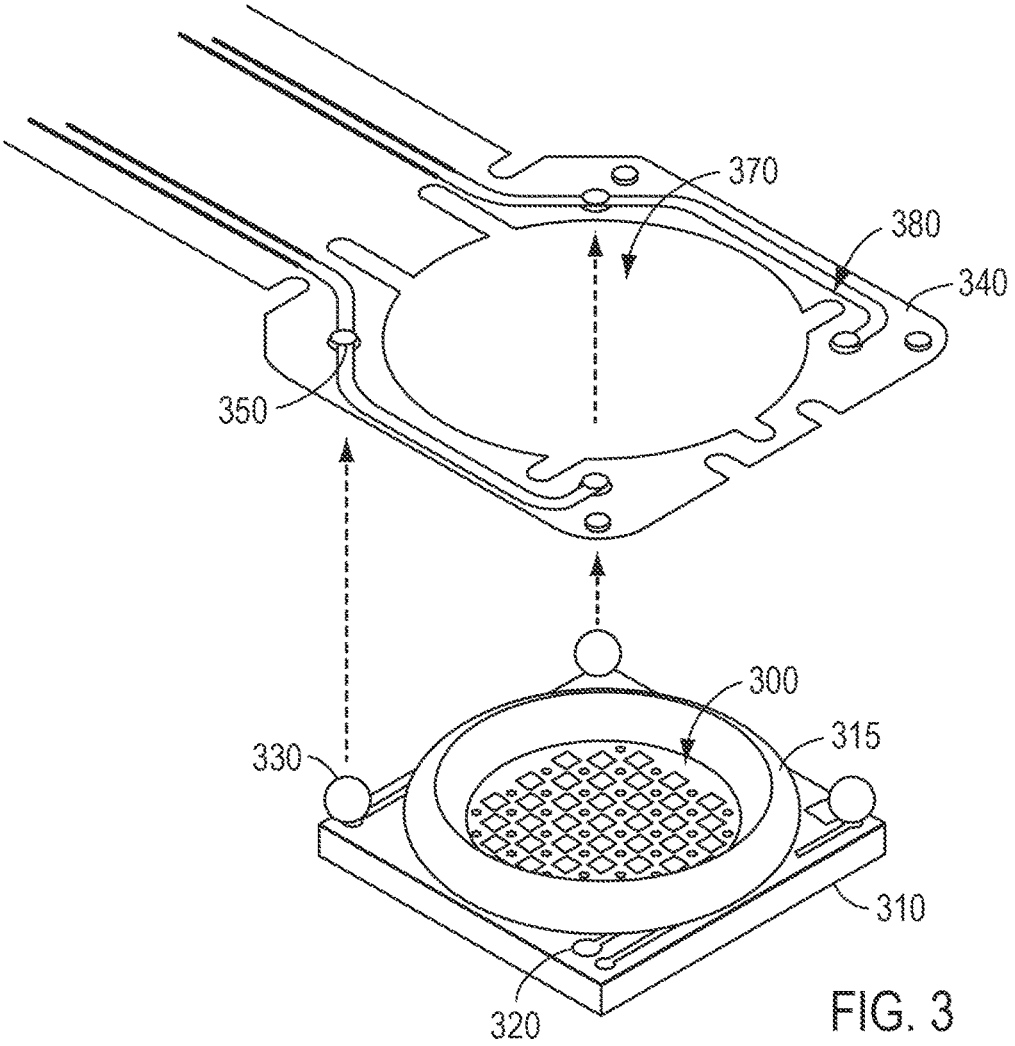
FIG. 3 and FIG. 4 show LED package subassemblies according to certain embodiments.
Figure 4:
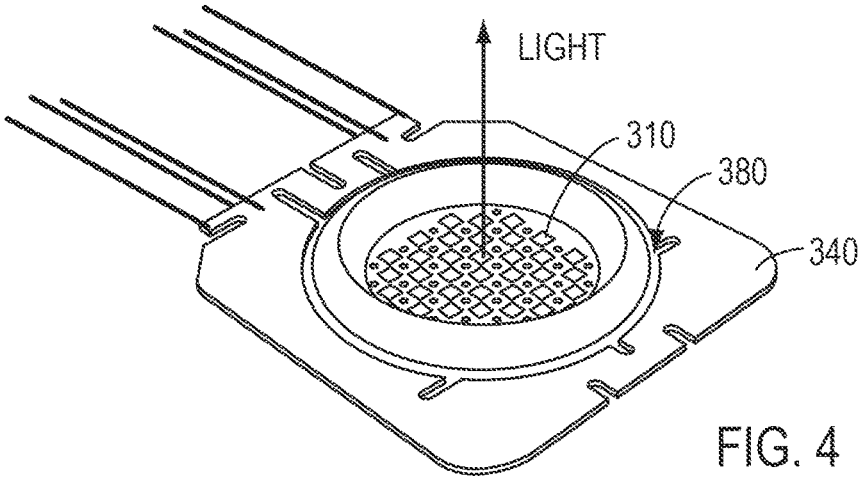

FIGS. 3 and 4 illustrate an embodiment of the present invention. More specifically, a plurality of LEDs 300 is illustrated disposed upon a substrate 310. In some embodiments, the plurality of LEDs 300 can be connected in series and powered by a voltage source of approximately 120 volts AC (VAC). To enable a sufficient voltage drop (e.g., 3 to 4 volts) across each LED 300, in various embodiments 30 to 40 LEDs can be used. In some embodiments, 37 to 39 LEDs can be coupled in series. In some embodiments, LEDs 300 can be connected in parallel series and powered by a voltage source of approximately 40 VAC. For example, the plurality of LEDs 300 include 36 LEDs arranged in three groups each having 12 LEDs 300 coupled in series. Each group can be coupled in parallel to the voltage source (40 VAC) provided by the LED driver circuitry, such that a sufficient voltage drop (e.g., 3 to 4 volts) is achieved across each LED 300. In other embodiments, other driving voltages can be used, and other arrangements of LEDs 300 can be used.

In various embodiments, the LEDs 300 are mounted upon a silicon substrate 310, or other thermally conductive substrate. In various embodiments, a thin electrically insulating layer and/or a reflective layer may separate LEDs 300 and the silicon substrate 310. Heat produced from LEDs 300 can be transferred to silicon substrate 310 and to a heat sink via a thermally conductive epoxy, as disclosed herein.

In various embodiments, a silicon substrate can be approximately 5.7 mm×5.7 mm in size, and approximately 0.6 microns in depth. The dimensions may vary according to specific lighting requirements. For example, for lower brightness intensity, fewer LEDs may be mounted upon the substrate, and accordingly the substrate may decrease in size. In other embodiments, other substrate materials may be used and other shapes and sizes may also be used, such as approximately ovoid or round.

In various embodiments, the silicon substrate 310 and/or flexible printed circuit (FPC) 340 may have a specified (e.g., controlled) color, or these surfaces may be painted or coated with a material of a specified (e.g., controlled) color. In some embodiments, it has been recognized that some light from LEDs 300 that enters lens 210 may escape from the backside of lens 210. This escaped light may reflect from silicon substrate 310 and/or flexible printed circuit (FPC) 340, enter lens 210 and be output from the front of lens 210. As a result light output from lens 210 may be tinted, colored, or affected by the color of silicon substrate 310 and/or FPC 340. Accordingly, in some embodiments, the surface coloring of these surfaces can be controlled. In some instances, the color may be whitish, bluish, reddish, or any other color that is desired. In various embodiments, portions of heat sink 230 may also have a controlled color for similar reasons. For example, the surface of heat sink 230 facing lens 210 may be painted or anodized in a specific color such as white, silver, yellow, or the like. This surface may have a different color compared to other surfaces of heat sink 230. For example, heat sink 230 may be bronze in color, and the inner surface of heat sink 230 facing lens 210 may be silver in color, or the like.

As shown in FIG. 3, a ring of silicone 315 can be disposed around LEDs 300 to define a well-type structure. In various embodiments, a phosphorus bearing material can be disposed within the well structure. In operation, LEDs 300 provide a blue-ish light output, a violet, or a UV light output. In turn, the phosphorous bearing material can be excited by the blue/UV output light, and emits white light output. Further details of certain embodiments of plurality of LEDs 300 and substrate 310 are described in the documents incorporated by reference.

As illustrated in FIG. 3, a number of bond pads 320 may be provided upon substrate 310 (e.g., 2 to 4). A conventional solder layer (e.g., 96.5% tin and 5.5% gold) may be disposed upon silicon substrate 310, such that one or more solder balls 330 are formed thereon. In the embodiments illustrated in FIG. 3, four bond pads 320 are provided, one at each corner, two for each power supply connection. In other embodiments, only two bond pads may be used, one for each AC power supply connection.

Illustrated in FIG. 3 is a flexible printed circuit (FPC) 340. In various embodiments, FPC 340 may include a flexible substrate material such as a polyimide, such as Kapton™ from DuPont, or the like. As illustrated, FPC 340 may have a series of bonding pads 350, for bonding to silicon substrate 310, and bonding pads 360, for coupling to the high supply voltage (e.g., 120 VAC, 40 VAC, etc.). Additionally, in some embodiments, an opening 370 is provided, through which LEDs 300 will shine through.

Various shapes and sizes for FPC 340 can be used. For example, as illustrated in FIG. 3, a series of cuts 380 may be made upon FPC 340 to reduce the effects of expansion and contraction of FPC 340 versus substrate 310. As another example, a different number of bonding pads 350 may be provided, such as two bonding pads. As another example, FPC 340 may be crescent shaped, and opening 370 may not be a through hole.

In FIG. 4, substrate 310 can be bonded to FPC 340 via solder balls 330, in a conventional flip-chip type arrangement to the top surface of the silicon. By making the electrical connection at the top surface of the silicon, the electrical connections are electrically isolated from the heat transfer surface of the silicon. This allows the entire bottom surface of the silicon substrate 310 to transfer heat to the heat sink. Additionally, this allows the LED to bonded directly to the heat sink to maximize heat transfer instead of a PCB material that typically inhibits heat transfer. As shown in this configuration, LEDs 300 are thus positioned to emit light through opening 370. In various embodiments, a potting compound can also serve as an under fill or the like to seal the space 380 between substrate 310 and FPC 340.

After the electronic driving devices and the silicon substrate 310 are bonded to FPC 340, the LED package subassembly or module 220 is thus assembled. In various embodiments, these LED modules may then be individually tested for proper operation.

Figure 5:
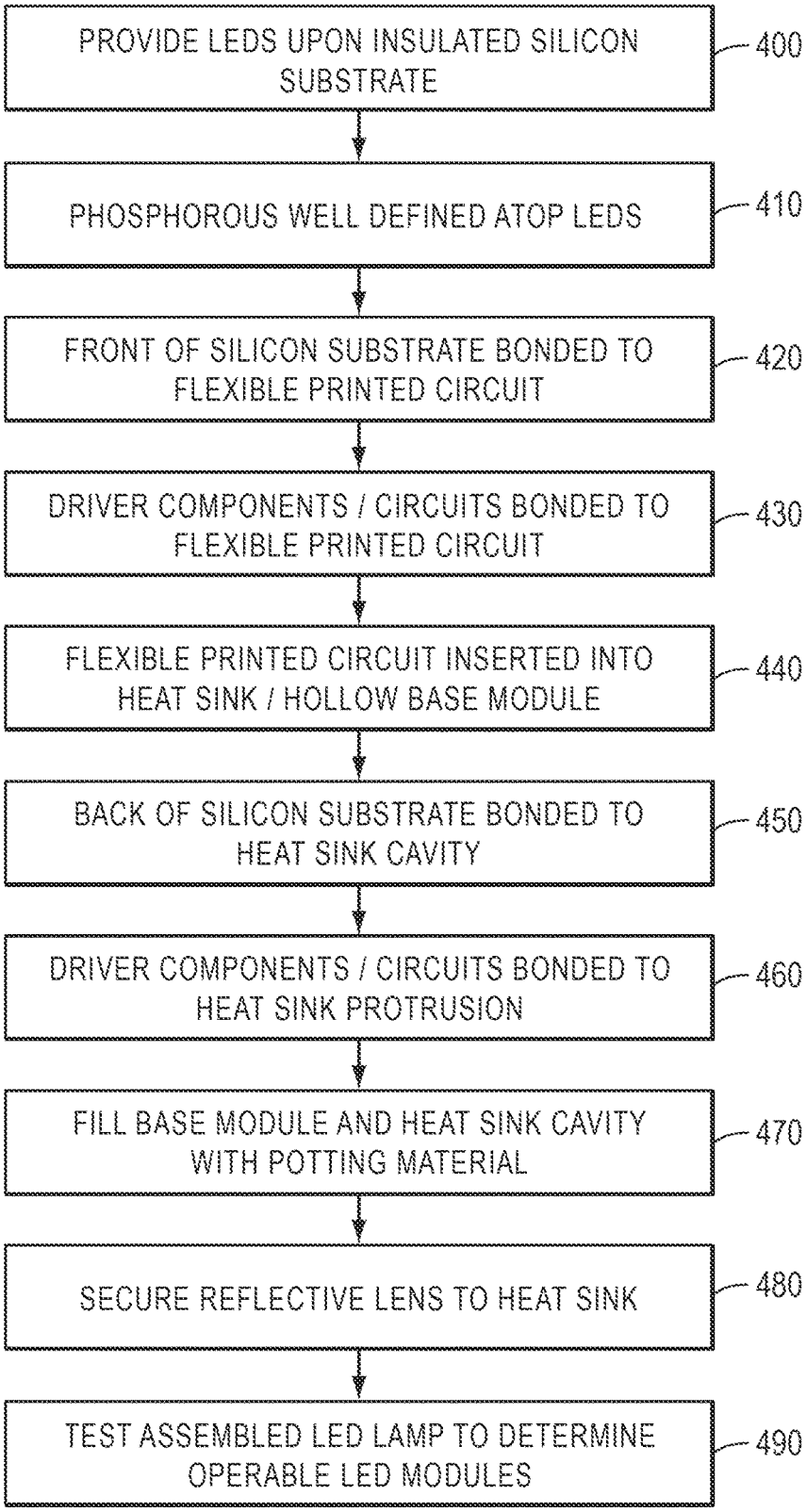
FIG. 5 shows a flow diagram for a manufacturing or assembly process of an LED lamp according to certain embodiments.
Figure 6A:
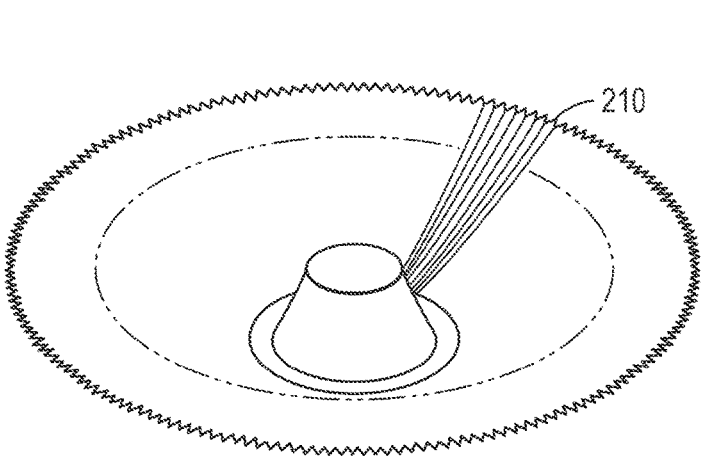
FIGS. 6A-6C and FIG. 7 show certain embodiments of a reflective lens.
Figure 6B:
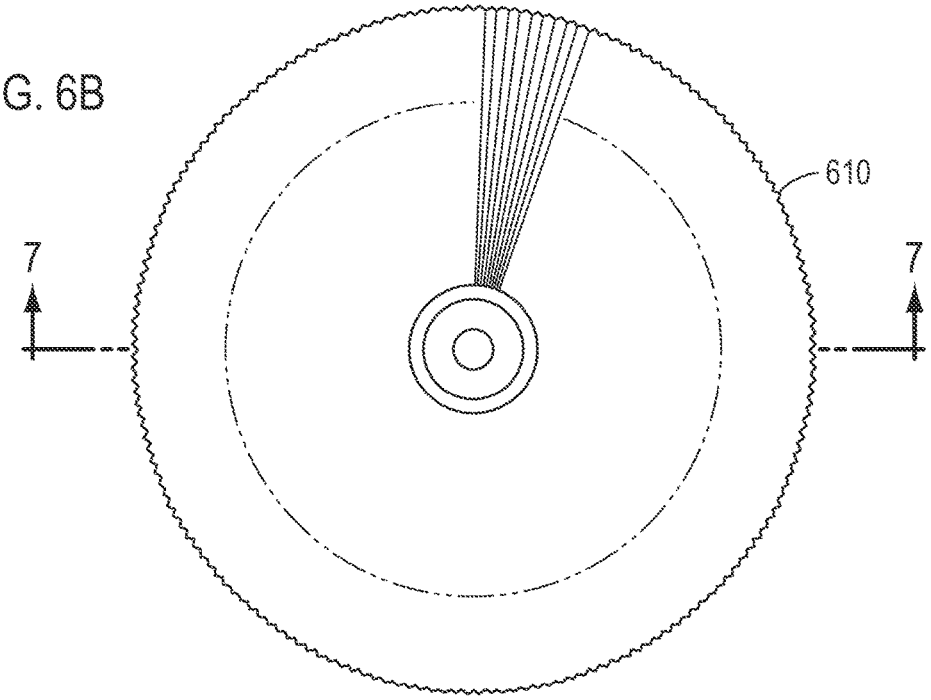
Figure 6C:
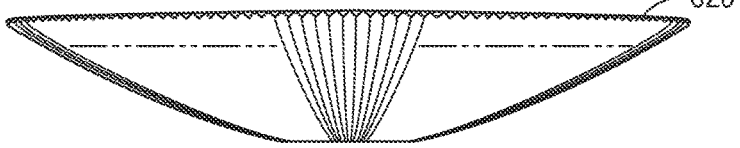

FIG. 5 illustrates a flow diagram of a manufacturing process according to embodiments. In various embodiments, some of the manufacturing separate processes may occur in parallel or in series.

In various embodiments, the following process may be performed to form an LED assembly/module. Initially, a plurality of LEDs 300 are provided upon an electrically insulated silicon substrate 310 and wired, step 400. As illustrated in FIG. 3, a silicone dam 315 is placed upon the silicon substrate 310 to define a well, which is then filled with a phosphor-bearing material, step 410. Next, the silicon substrate 310 is bonded to a flexible printed circuit 340, step 420. As disclosed herein, a solder ball and flip-chip soldering (e.g., 330) may be used for the soldering process in various embodiments.

Next, a plurality of electronic driving circuit devices and contacts may be soldered to the flexible printed circuit 340, step 430. The contacts are for receiving a driving voltage of approximately 12 VAC. As discussed herein, unlike present state of the art MR-16 light bulbs, the electronic circuit devices, in various embodiments, are capable of sustained high-temperature operation, e.g., 120 degrees C.

In various embodiments, the second portion of the flexible printed circuit including the electronic driving circuit is inserted into the heat sink and into the inner cavity of the base module, step 440. As illustrated, the first portion of the flexible printed circuit is then bent approximately 90 degrees such that the silicon substrate is adjacent to the recess of the heat sink. The back side of the silicon substrate is then bonded to the heat sink within the recess of the heat sink using an epoxy, or the like, step 450.

In various embodiments, one or more of the heat producing the electronic driving components/circuits may be bonded to the protrusion portion of the heat sink, step 460. In some embodiments, electronic driving components/circuits may have heat dissipating contacts (e.g., metal contacts) These metal contacts may be attached to the protrusion portion of the heat sink via screws (e.g., metal, nylon, or the like). In some embodiments, a thermal epoxy may be used to secure one or more electronic driving components to the heat sink. Subsequently a potting material is used to fill the air space within the base module and to serve as an under fill compound for the silicon substrate, step 470.

Subsequently, a reflective lens may be secured to the heat sink, step 480, and the LED light source may then be tested for proper operation, step 490.

Figure 7:
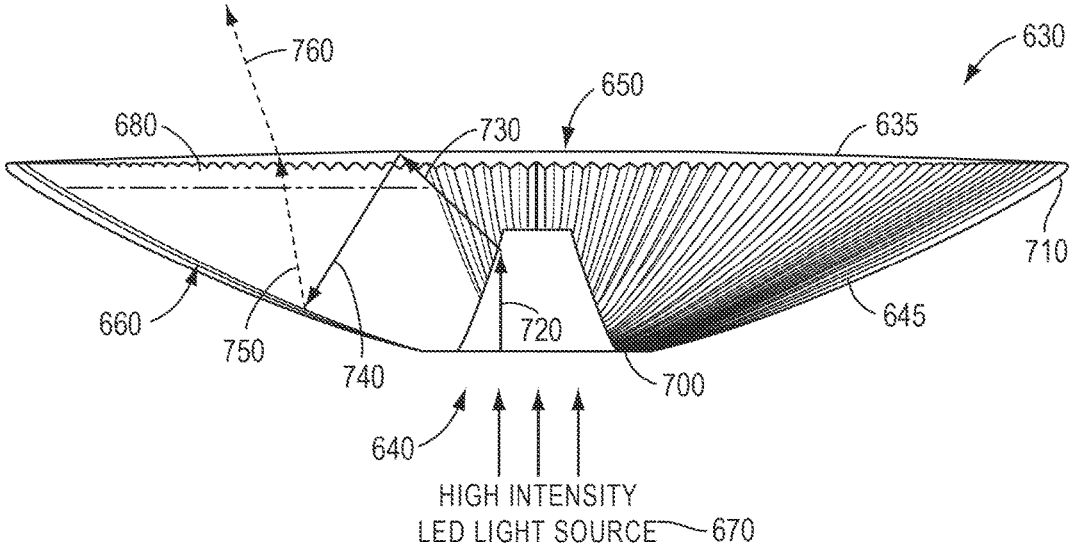

FIGS. 6A-6C and 7 illustrate various views of certain embodiments of a reflective lens 600. More specifically, FIGS. 6A-6C include perspective view 210, a top view 610 and a side view 620, respectively, of a reflective lens 600, and FIG. 7 illustrates a close-up view of a cross-section 630 (profile 7-7 in FIG. 6B) according to various embodiments.

In various embodiments, reflective lens 600 is monolithic and fabricated via a molding process. In other embodiments, reflective lens 600 may be fabricated via a molding and etching process. Reflective lens 600 may be formed from a transparent material such as Makrolon™ LED 2045 or LED 2245 polycarbonate available from Bayer Material Science AG. In various embodiments, a forward-facing side 635 and a rearward-facing side 645 define bounds of the transparent material forming reflective lens 600.

As shown by cross-section 630 of FIG. 7, reflective lens 630 includes a body 680 with number of physical regions including a light receiving region 640, a combined light reflecting region 635 and a light output region 650, and a light blending region 660.

Figure 8:
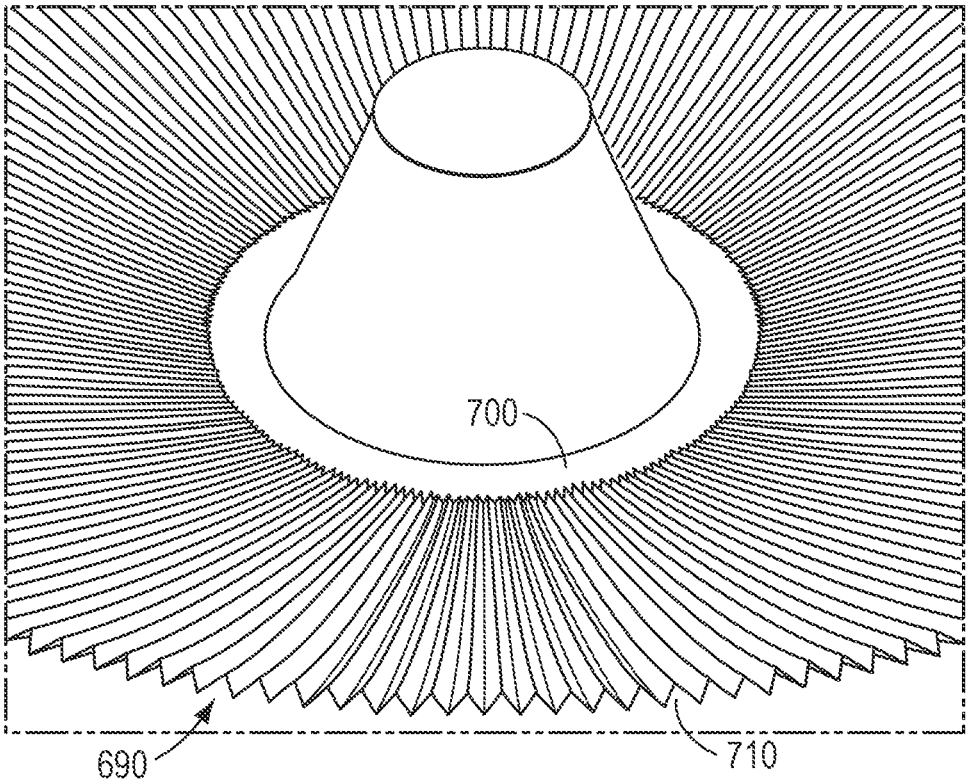
FIG. 8 and FIG. 9 show details of an edge configuration for a reflective optic according to certain embodiments.
Figure 9:
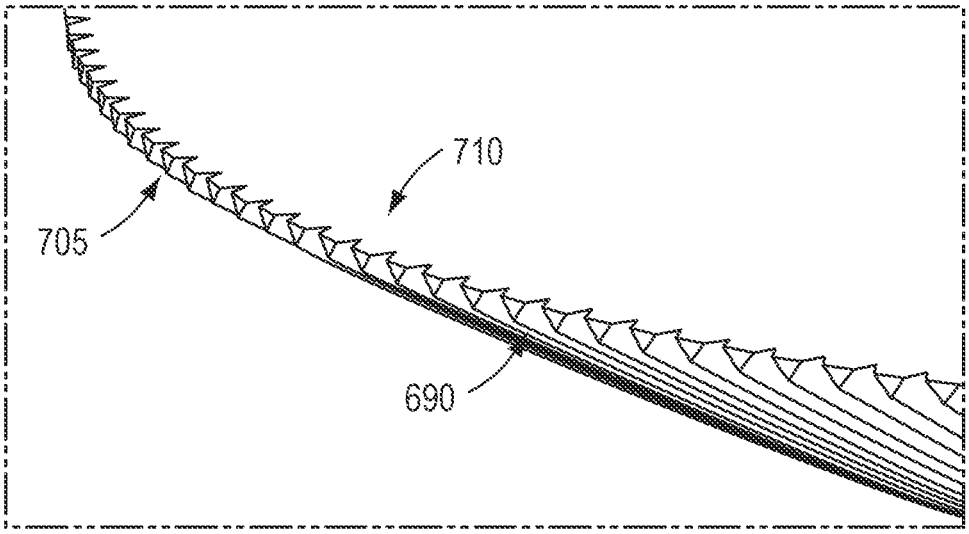

FIGS. 8 and 9 illustrate detailed diagrams according to various embodiments. As shown in FIG. 8, in various embodiments, light blending region 660 comprises a plurality of prism structures (e.g., triangular prismatic structures 690). In some embodiments, the prismatic structures 690 begin in an inner region 700 and extend toward an outer perimeter 710 following along the countour of rearward-facing side 645 (FIG. 7). In other embodiments, prismatic structures 690 may follow other paths along the countour of rearward-facing side 645, such as a spiral pattern, concentric pattern, or the like.

In some embodiments of the present invention, for an MR-16 light source, there are approximately 180 (within a range of 150 to 200) prismatic structures (e.g., each prismatic structure is approximately 2 degrees). Accordingly, at the outer perimeter, the pitch between prisms is approximately 0.8 mm (within a range of 0.75 mm to 1 mm) Additionally, the peak to trough depth is approximately 0.4 mm (within a range of 0.3 mm to 0.5 mm). In other embodiments, the number of prismatic structures, the pitch, the depth, or the like may change depending upon a specific design.

In some embodiments, an internal angle of the prismatic structures is constant as measured by a tangent line along rearward-facing side 645. In some embodiments, the angles may be slightly less than 90 degrees (e.g., 85, 89, 89.5 degrees, or the like); the angles may be slightly more than 90 degrees (e.g., 90.5, 91, 95 degrees, or the like); or the angles may be approximately 90 degrees.

In some embodiments, the internal angles of the prismatic structures need not be constant, and may depend on a radial distance away from light receiving region. For example, near inner region 700, the angle may be slightly more than 90 degrees (e.g., 91, 95 degrees, or the like), and at outer region 710, the angle may be much larger than 90 degrees (e.g., 110, 120 degrees, or the like). In some embodiments, modification of the angle may help reduce or increase hotspots, reduce undesired voids, or modify the beam shape, as desired.

As illustrated in the example in FIG. 9, at outer perimeter 710, prismatic structures 690 may be flattened 705. In various embodiments, this may reduce breakage and facilitate mounting within a heat-sink.

In operation, in various embodiments as illustrated in FIG. 7, an LED source can provide high intensity light 670 (e.g., light ray 720) to light receiving region 640. In various embodiments, because of an index of refraction mismatch, high intensity light can bend within body 680 to form light ray 730. Next, in various embodiments, based upon the index of refraction mismatch, the light ray 730 from the light output region 640 internally reflects (light ray 740) at region 650 within body 680 toward light blending region 660.

In various embodiments, light blending region 660 changes the direction of light ray 740 received from region 650, to generally be directed toward region 650, e.g., light ray 750. Subsequently, at region 650, because of index of refraction mismatch, light ray 750 becomes light ray 760. In the example in FIG. 7, light rays 750 and 760 are dotted, as these light rays are typically not within the same two-dimensional plane as light rays 720, 730, and 740. For example, as illustrated in a top view in FIG. 10, light rays 730 and 740 are shown traversing body 680 within first plane 770. However, when light ray 740 strikes a left leaning prism face 790, it becomes light ray 745 that in turn strikes a right leading prism face 800 and become light ray 750. As shown, light ray 745 and 750 traverse body 680 within a second plane 780.

Figure 10:
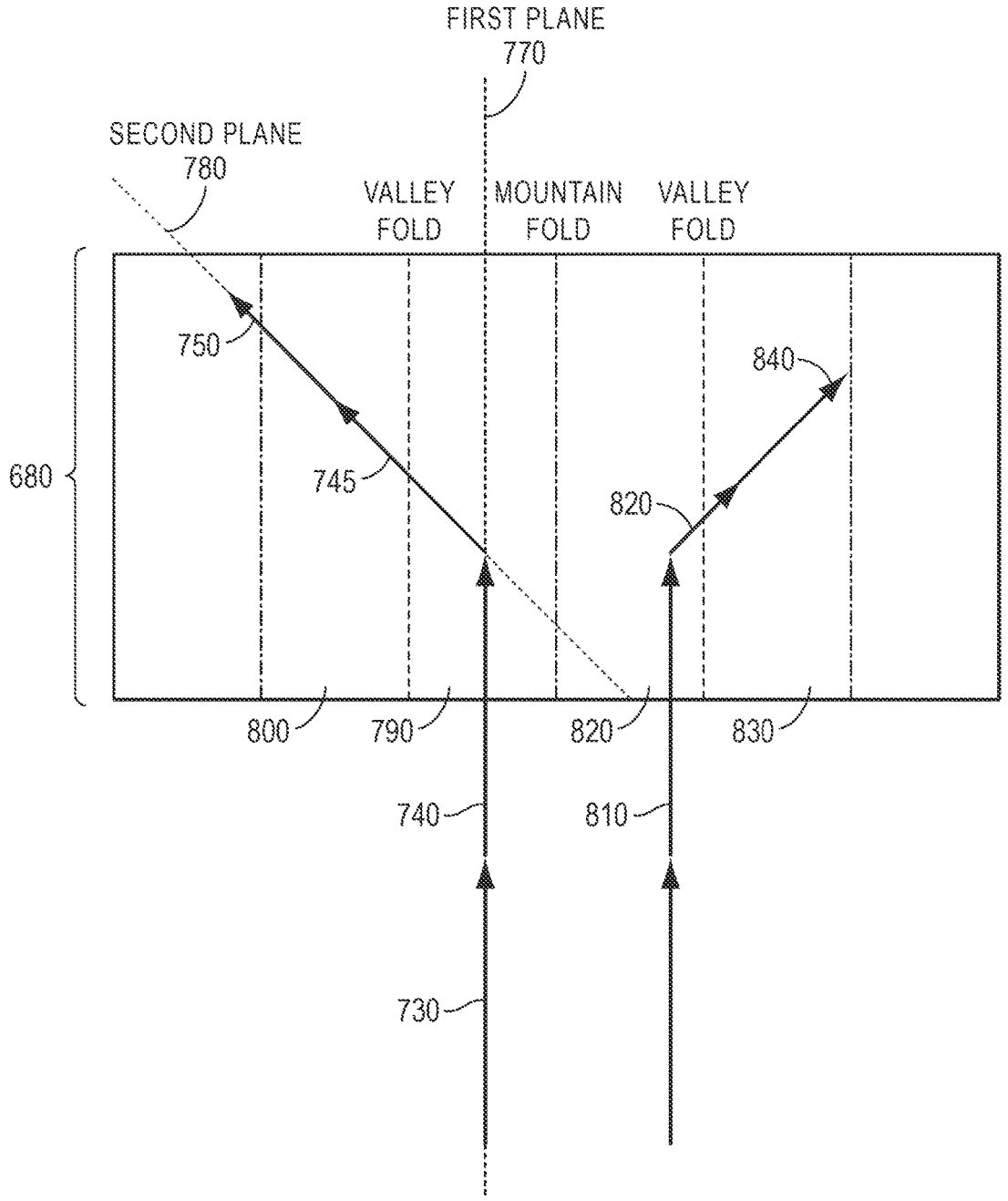
FIG. 10 shows examples of redirection of light rays within a reflective optic according to certain embodiments.

FIG. 10 also illustrates an example of out-of plane redirection of light rays at light blending region 660. In various embodiments, as approximately parallel light rays strike the prismatic structures, the light rays are redirected in different directions, depending upon which part of the prismatic structures the light rays strike. For example, a first light ray 740 strikes a first portion 790 of a first prismatic structure, bends to the left as light ray 745, strikes a first portion 800 of a second prismatic structure and is directed upwards and to the left as light ray 750 toward region 650. In contrast, a second light ray 810 strikes a second portion 820 of a first prismatic structure, bends to the right as light ray 820, strikes a first portion 830 of a second prismatic structure and directed upwards and to the right as light ray 840 toward region 650. Because the same effect occurs to other light rays that strike the prismatic structures, light that reaches a particular portion of region 650 may be light from different light rays from the high intensity light source. Accordingly, the light rays are blended and output from the reflective lens.

Figure 11:
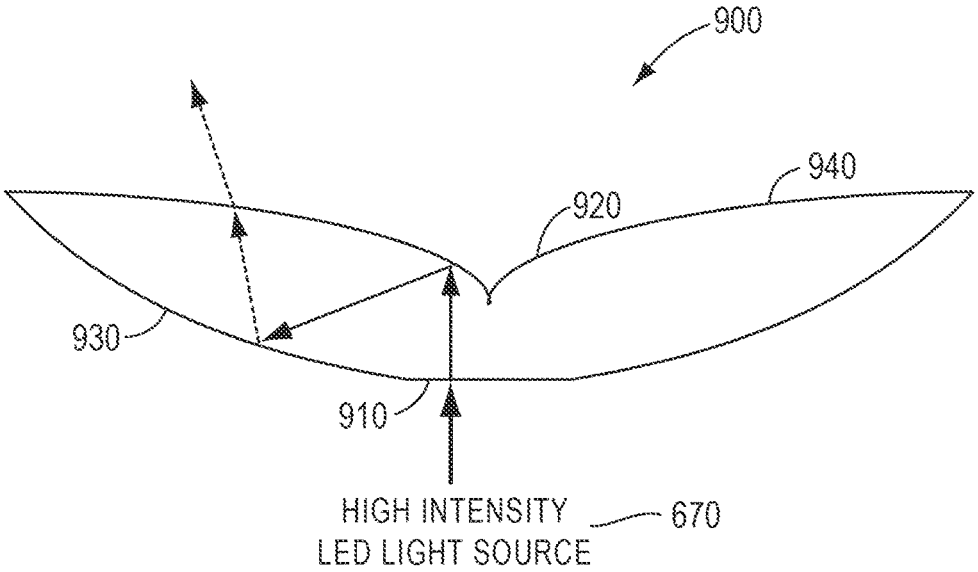
FIG. 11 shows a cross-section of a reflective optic according to certain embodiments.

FIG. 11 illustrates a cross-section of certain optics provided by the present disclosure. More specifically, a reflective lens 900, including a light receiving region 910, a light reflection region 920, a light blending region 930, and a light output region 940. As disclosed herein, in various embodiments, light reflection region 920 and light output region 940 may be the same physical surface. As shown in FIG. 11, light receiving region 910 may be flat, compared to other embodiments illustrated herein. Further, it should be understood that the outer perimeter may be flattened similar to flattened 705 region in prismatic structures 690, as desired.

As shown in FIG. 11, high intensity light 940 is provided to light receiving region 910. The light enters reflective lens 900 and internally reflects within light reflection region 920. The reflected light strikes the light blending region 930, and as described above, bends the light into a different two-dimensional plane (dotted lines). The blended light is output from light output region 940.

In addition to TIR lenses, another class of lens is known as a "folded TIR lens". Use of this type of lens allows the diameter of the lens to be larger while reducing the overall height, and thus, for a given form factor of an LED lamp (e.g., an MR-16 form factor) a fan can be included in the inner volume of the lamp without unduly sacrificing certain design objectives such as operating temperature, illumination uniformity, and/or light output efficiency.

In certain embodiments, an LED lamp is provided comprising a single LED package light source; a fan; and folded total internal reflection optic s to substantially direct light emitted from the single LED package light source.

Figure 12:
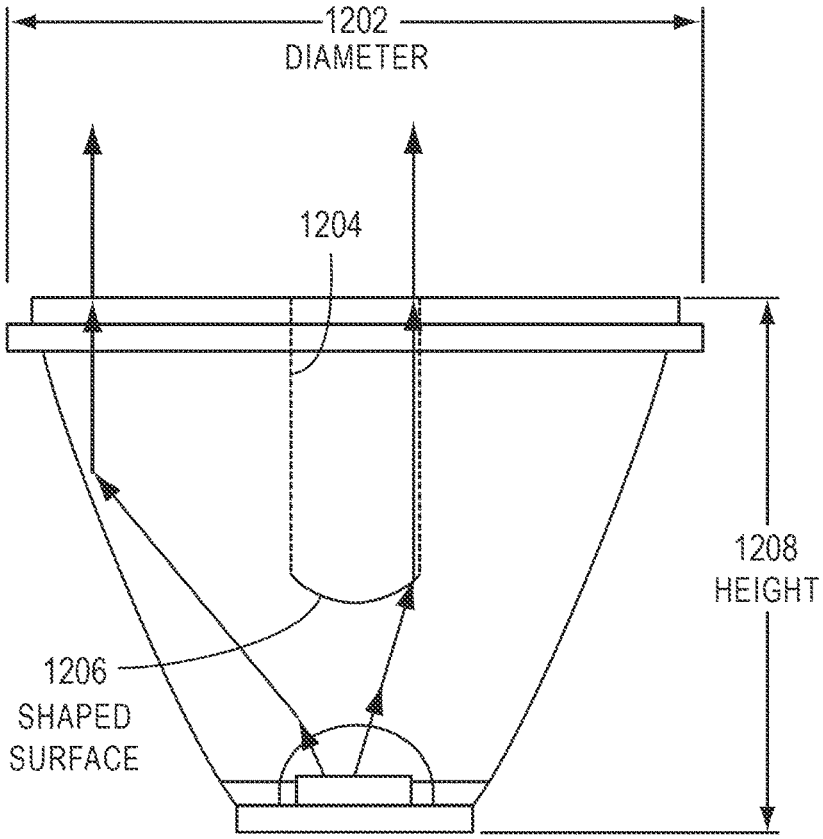
FIG. 12 is a diagram of a lens shape used in some designs for a compact LED lamp according to certain embodiments.

FIG. 12 shows a lens shape used in some designs for a compact LED lamp.

As shown in FIG. 12, the lamp has a diameter 1202 and a height 1208 (not necessarily to scale). As indicated, there is an optimal relationship between the diameter 1202 of the lens and the height 1208 of the lens. The lamp also includes an inner surface 1204 of a lens opening and a shaped surface 1206. Light rays (lines with arrows) incident on the inner surface of a lens opening (or on the shaped surface) obey Brewster's law such that, at some angles (a "critical angle" that depends on the index of refraction of the materials), light is not reflected from the incident surface and instead obeys the principles of total internal reflection (TIR). By selecting a shape and juxtaposition so as to control the angle of incidence of the light emitted from the LED and by selecting suitable materials, the light emitted from the LED may be totally internally reflected. Moreover, the shape of the materials can be selected so as to guide light trajectories through a 90-degree angle.

Figure 13:
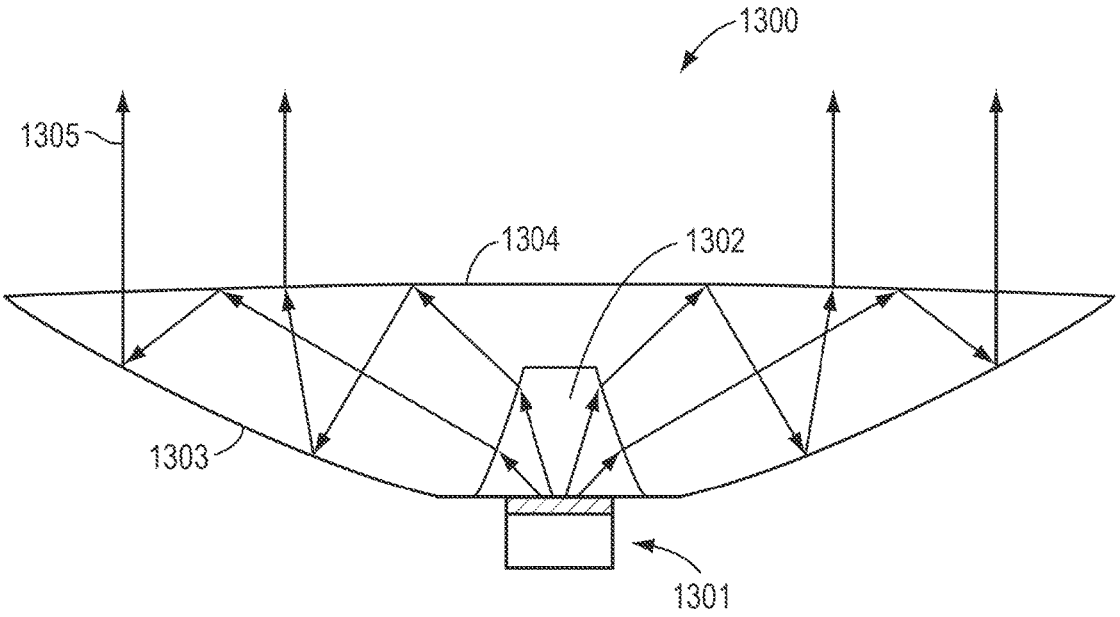
FIG. 13 is diagram showing TIR ray trajectories in a shallow lens shape used in designs for a compact LED lamp with a folded optic proximal to a heat sink and a fan, according to certain embodiments.

FIG. 13 is a diagram 1300 showing TIR ray trajectories in a shallow lens shape used in designs for a compact LED lamp with folded optic 210 proximal to heat sink and fan.

As shown in FIG. 13, light originates from a LED package light source 1301, which LED package light source 1301 is mounted atop a heat sink. The light from LED package light source 1301 passes through a first lens 1302 such that light is guided in directions so as to be incident on reflective surface 1304 followed by reflective surface 1303. The light trajectory, after striking the reflectors, is substantially collimated in one direction, as depicted by rays 1305.

Figure 14:
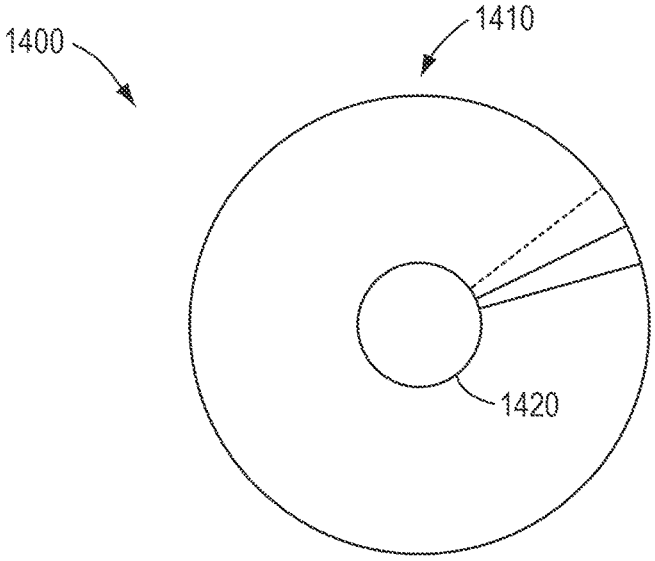
FIG. 14 is a diagram depicting TIR ray trajectories in a folded lens shape, according to certain embodiments.

FIG. 14 is a schematic diagram 1400 for describing TIR ray trajectories in a folded lens shape.

As shown in FIG. 14, the design of the reflector 1410 includes an array of right-angle prisms. The shape of each of the prisms is substantially triangular so they can be disposed in a sidewall-abutted arrangement. As shown, the longitudinal dimensions of the prisms run along the radial lines (from center area 1420 to the edge) of the reflector.

Figure 15:
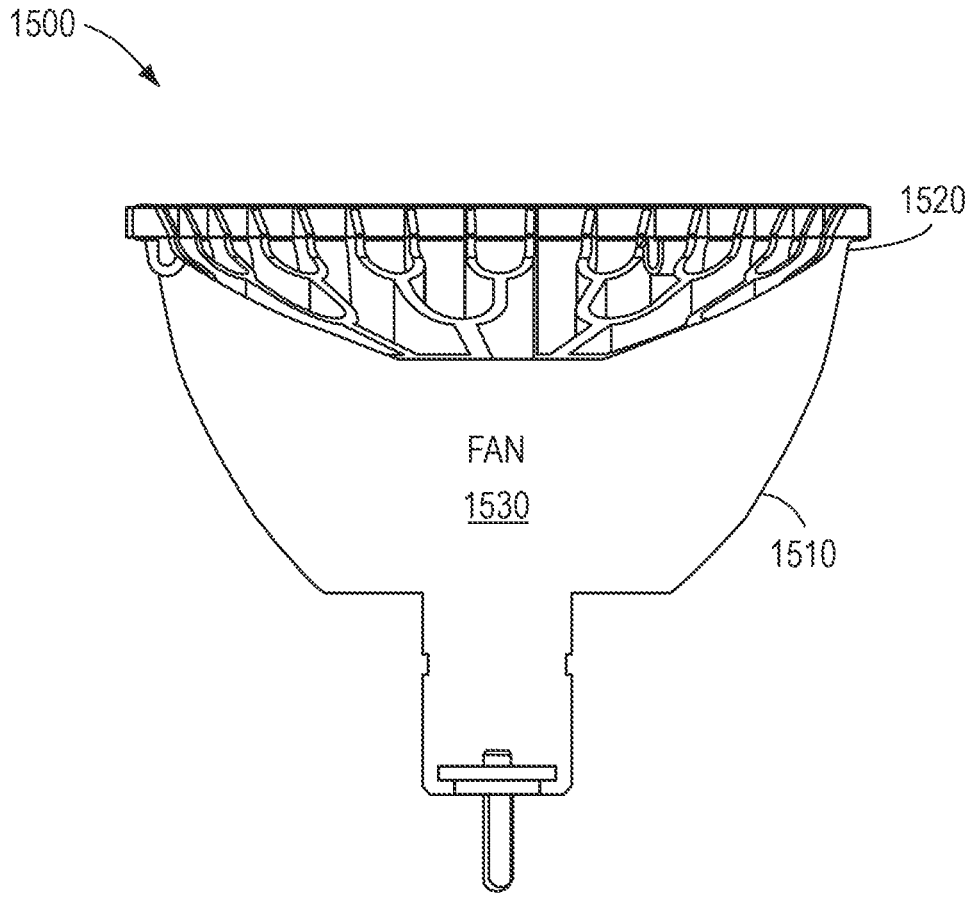
FIG. 15 shows an MR-16 form factor lamp having a folded TIR optic proximal to a heat sink and a fan, according to certain embodiments.

FIG. 15 is a schematic diagram showing an MR-16 form factor lamp having a shallow lens shape 1500 as used in designs for a compact LED lamp with folded TIR optics 1520 proximal to finned heat sink 1510 and fan 1530.

Embodiments provided by the present disclosure include methods for providing a LED lamp in a compact form factor such as an MR-16 form factor. The methods include combining a single LED package light source and a fan, with a folded optic. The folded optic, which may be a totaling internally reflection optic, to direct light emitted from the single LED package light source. Devices disclosed herein can be combined to provide LED lamps having a small form factor.

In certain embodiments, an LED lamp comprises a single LED package light source; a fan; and a folded optic to substantially direct light emitted from the single LED package light source. In certain embodiments, the LED lamp is provided in a MR16 form factor. In certain embodiments, the folded optic comprises a total internal reflection lens. In certain embodiments, the folded optic is configured to direct light emitted by the single LED package light source in substantially one direction. In certain embodiments, the LED lamp comprises a hemispherical lens disposed adjacent the single LED package light source. In certain embodiments, the LED lamp comprises a reflector disposed on an area of the folded optic such that light emitted by the single LED light source is incident on the reflector. In certain embodiments, the reflector comprises an array of right-angle prisms.

Figure 16:
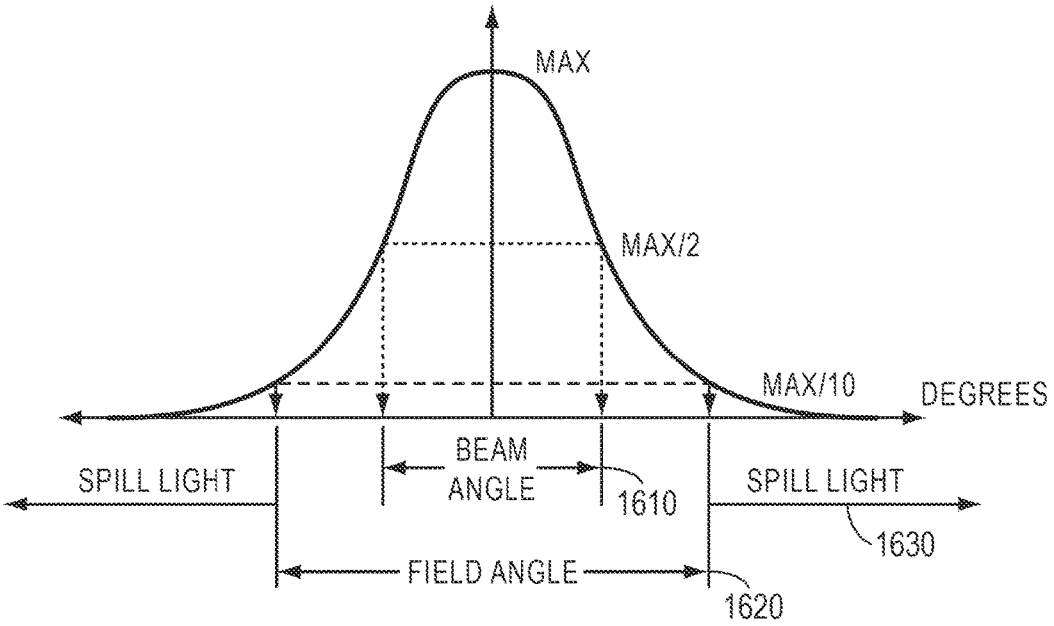
FIG. 16 and FIG. 17 show examples of output intensity profiles for LED lamps according to certain embodiments.

FIG. 16 illustrates concepts according to embodiments of the present invention. More specifically, FIG. 16 illustrates an example of an output intensity of light source. In this example, a beam angle 1610 is defined as the solid angle where the light intensity is at least half of the peak light intensity or the angle where light intensity of a light source drops to about 50% of the light source. In this example, an output light having intensity of 2000 candle power will have a beam angle measured where the light is reduced to about 1000 candle power. The engineered size of beam angle 1610 depends upon the user desired qualities of the light source. For example, if a tight-narrow beam is desired, beam angle 1610 may be small, for example 5 degrees, whereas if a flood-light beam is desired, beam angle 1610 may be wide, for example 60 degrees.

In this example, a field angle 1620 is defined as the solid angle where the light intensity is at least one tenth of the peak light intensity, or the angle where the light intensity of a light source drops to about 10% of light source. For example, a light having intensity of 2000 candle power light will have a field angle measured where the light is reduced to about 200 candle power. The size of field angle 1620 depends upon the qualities of a light source desired by the user. For example, if a tight-narrow beam is desired, beam angle 1610 and field angle 1620 are small and very close to each other (e.g., 10 degrees and 15 degrees, respectively); and if a flood-light beam is desired, beam angle 1610 may be wide, for example, 30 degrees, and field angle 1620 may also be wider, for example 90 degrees. In various embodiments, the intensity of light outside beam angle 1610 typically decreases, as illustrated in spill light region 1630.

Figure 17:
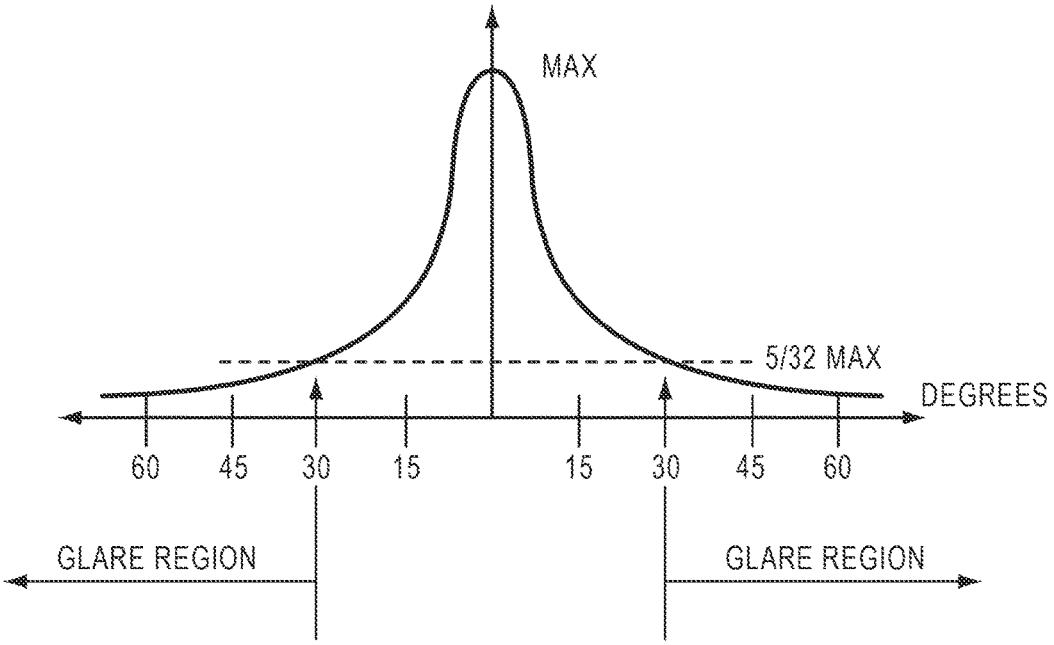

In various embodiments, light having uncontrolled or high light intensity outside a glare angle is defined herein as glare. In various embodiments, a glare region may range from about 30 degrees from the center axis to about 60 degrees from the center axis; in another example, a glare region may be directed upon light within a range of about 30 degrees from the center axis to about 45 or about 75 degrees from the center axis; in other embodiments, other ranges may also be considered and used. In certain embodiments, a center axis refers to the central geometric or physical axis of the lamp, such as the optical aperture. In certain embodiments, a center axis refers to the vector extending from the LED light source through the maximum intensity of the output light. In certain embodiments, these may be coincident. Eye discomfort of a user due to such light is very subjective. However, for purposes herein, light within the glare region having an intensity contrast ratio compared to the maximum intensity of greater than about 1:1000 is considered herein as glare. In other embodiments, other ratios may be used to indicate glare, for example, 1:2000, 1:10,000, or the like. In the example in FIG. 17, at about 30 degrees from the center axis, the light intensity is about 5/32 the maximum intensity, leading to a ratio of about 1:6.4. Accordingly, in one example, because the light ratio of 1:6.4 is greater than 1:1000 within a glare region from 30 to 60 degrees off-axis, the light source would we seen as undesirable glare by a user.

Figure 18A:
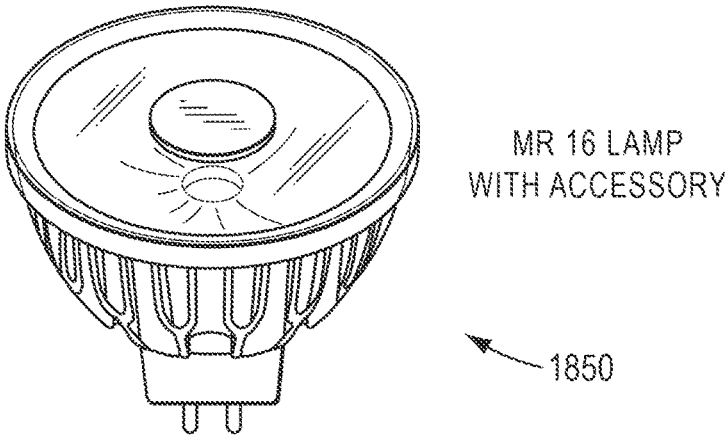
FIG. 18A and FIG. 18B show LED lamps having an MR16 form factor and including a heat sink according to certain embodiments.
Figure 18B:
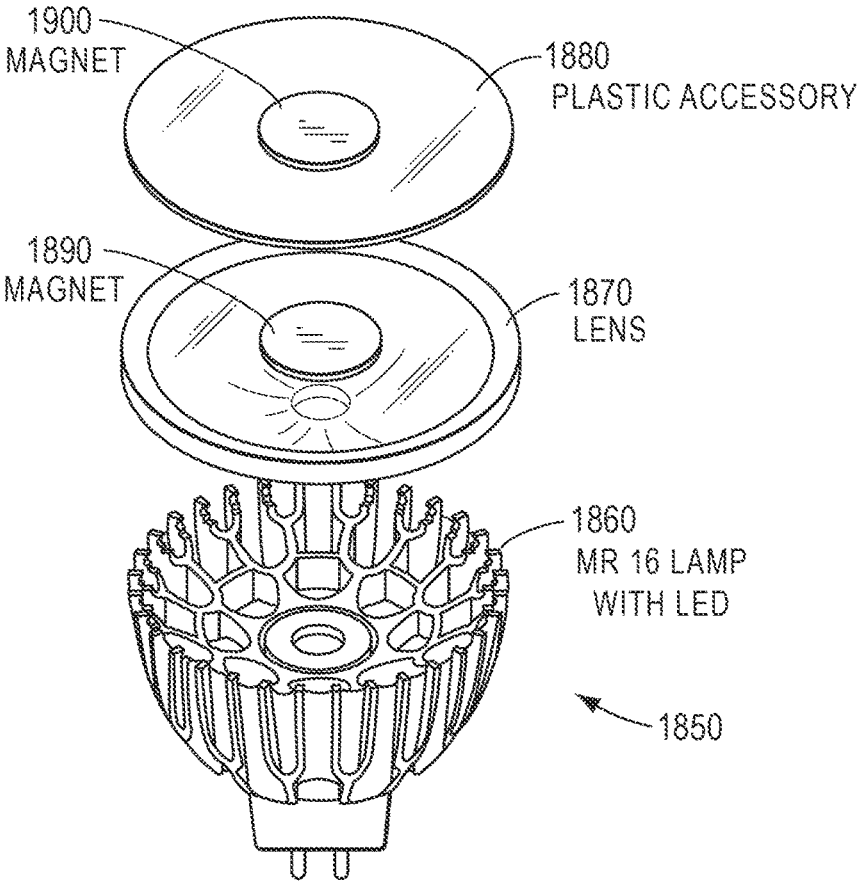

FIGS. 18A and 18B show another example of an LED lamp 1850 having an MR16 form factor including a heat sink 1860. As disclosed herein, a lens 1870 is attached to the heat sink 1860 or other part of the lamp 1850. In certain embodiments, the lens 1870 comprises a folded total internal reflection lens described above. Attachment may be mechanically such as using metal prongs, or the like. In this embodiment, a magnet 1890 is attached to the center of the lens 1870. An accessory 1880 having a magnet 1900 attached to the center can be disposed over the lens 1870 and the opposing magnets 1890 and 1900 can hold the accessory 1880 to the lens 1870. The first and second opposing magnets (1890 and 1900) can be configured to retain the accessory 1880 against the perimeter of the lens 1870. In some embodiments, the opposing magnets (1890 and 1900) may have the opposite polarity. The accessory 1880 may have substantially the same diameter as the lens 1870, and in certain embodiments covers an optical region of the lens 1870, such as for example greater than 90% of the optical aperture of the LED lamp. In certain embodiments, the accessory 1880 comprises a transparent film such as for example a plastic film. In certain embodiments, the accessory 1880 may be a diffuser, a color filter, a neutral density filter, a polarizer, a linear dispersion element, a baffle, a beam shaping element, and a combination of any of the foregoing. In certain embodiments, the first magnet 1900 and the first accessory 1880 have a combined thickness less than about 3 mm, less than about 2 mm, less than about 1 mm, less than about 0.5 mm, and in certain embodiments, less than about 0.25 mm.

Figure 19A:
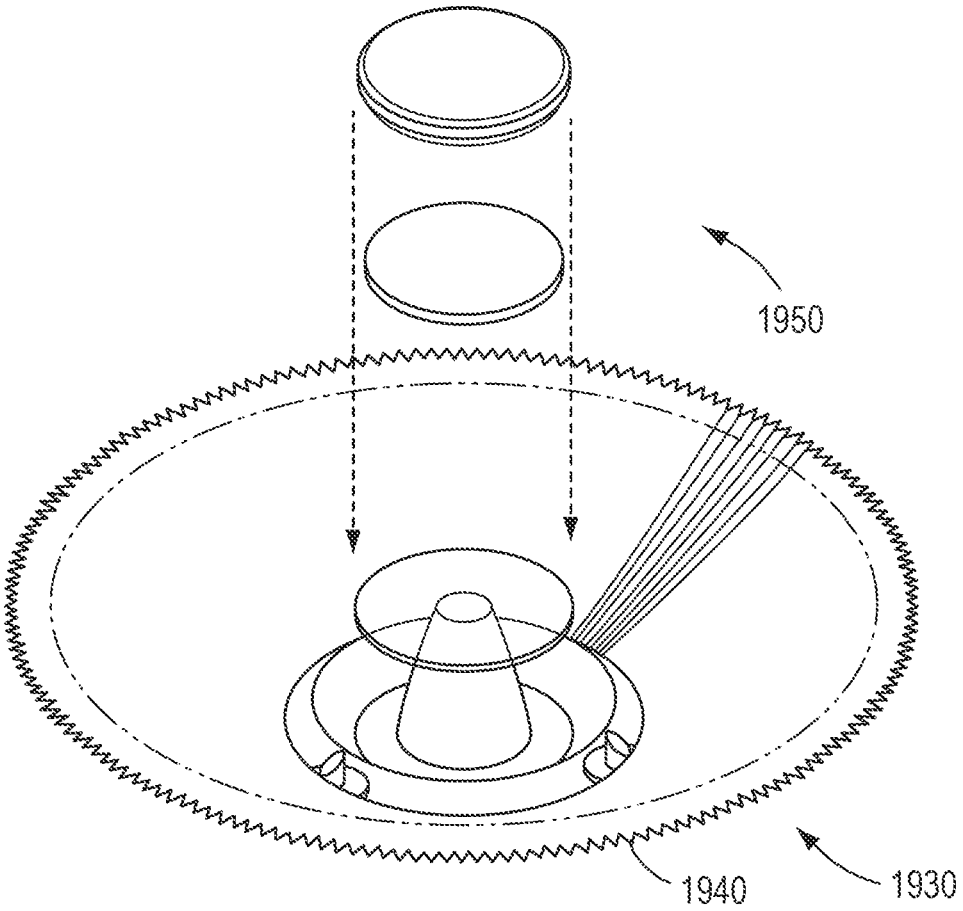
FIG. 19A and FIG. 19B show views of reflective lenses according to certain embodiments.
Figure 19B:
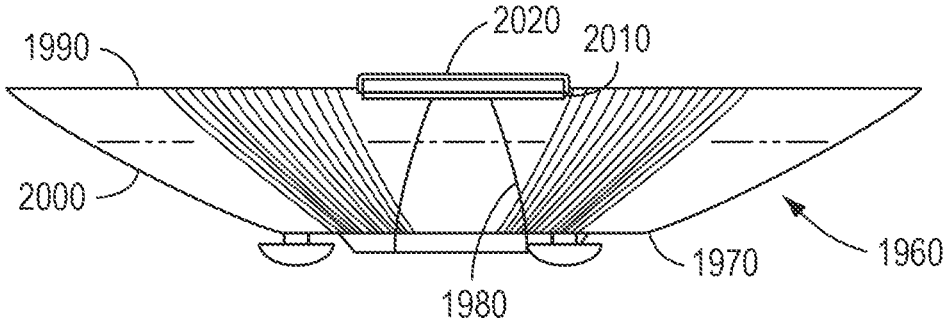

FIG. 19A and FIG. 19B illustrate various views of another embodiment of a reflective lens. More specifically, FIG. 19A includes an isometric view 1930 of a reflective lens 1940 including a glare cap 1950, and FIG. 19B illustrates a cross-section 1960 according to various embodiments.

Similar to the embodiment illustrated in FIGS. 19A-B, in various embodiments, reflective lens 1940 is monolithic and fabricated via a molding process. In other embodiments, reflective lens 1940 may be fabricated via a molding and/or etching process. As discussed above, reflective lens 1940 may be formed from a transparent material such as Makrolon™ LED 2045 or LED 2245 polycarbonate available from Bayer Material Science AG.

In various embodiments, glare cap 1950 may include a magnet and a opaque plastic cap, may include only a metal cap, may include only a magnet, or other combinations. In light of the present patent disclosure, one of ordinary skill in the art will recognize that many other embodiments for the glare cap are taught, and are within the scope of the present patent disclosure.

Similar to the embodiment illustrated in FIG. 7, in cross-section 1960 in FIG. 19B includes a body 1970 with number of physical regions including a light receiving region 1980 (a first air to material interface for light from a light source), a combined light reflecting region and a light output region 1990 (a first material to air interface for light from light receiving region and for light from the light bending/reflection region), and a light bending/reflection region 2000 (a second material to air interface for light from the light reflecting region 1990). In addition, as illustrated in this embodiment, a recess 2010 is provided in the central portion of light output region 1990, and a glare cap 2020 is disposed within recess 2010. In various embodiments, the diameter of glare cap 2020 compared to the diameter of light output region 1990 may be within a range of about 1:3 to about 1:5, within a range of about 1:3 to about 1:4.5, or the like. In specific examples, a glare cap is on the order of 19 mm, and the lens diameter is on the order of 83 mm; a glare cap is on the order of about 10.5 mm and the lens diameter is within a range of about 46.7 mm to about 49.5 mm; or the like.

Figure 20:
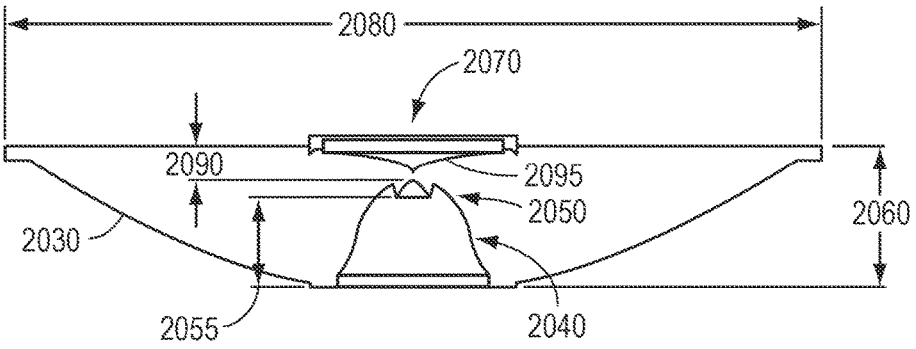
FIG. 20 shows an optic having a central light receiving region and a recessed peak or tier according to certain embodiments.

FIG. 20 illustrates a cross-section of another embodiment of the present invention. As shown in this embodiment, a central light receiving region 2040 may include a recessed peak or tier 2050. In various embodiments, the recessed peak 2050 enables the height 2060 of the lens 2070 to be thinner than would otherwise be possible relative to the width 2080. Conversely, recessed peak 2050 allows the central body 2070 to maintain a minimum body thickness 2090 to maintain overall strength and integrity. In other embodiments, more than one tier/recesses may be used within central light receiving region 2040. In various embodiments, the width or diameter to height may be within a range of about 5:1 to about 7:1, within a range of about 5:1 to about 6:1, or the like. In specific examples, a lens diameter is on the order of about 83 mm and the height is on the order of 15.2 mm; a lens diameter is within a range of about 46.7 mm to about 49.5 mm, and a lens height is within range of about 8.3 mm to about 8.9 mm.

In some embodiments, as illustrated in FIG. 20, a front surface of the lens, below a glare blocker may also be sloped as illustrated in 2095. This central conical-type depression within the front surface helps divert light directed upward toward the glare blocker away toward the rear reflective surface 2030.

Additionally, in various embodiments, a minimum distance 2055 may be maintained between the lens material (e.g., recessed peak 2050) and the underlying LED light source. In some cases, this minimum distance moves the LED light source outside of the central light receiving region 2040, as illustrated. This is in contrast to some of the prior art examples previously discussed. In some experiments, minimum distance 2055 is greater than about 0.3 mm. In cases where the distance is smaller than about 0.3 mm, the lens material has disadvantageously changed in properties, e.g., become less clear, yellowed, and the like. The change in lens material properties may be due to UV light, heat, or the like.

Figure 21:
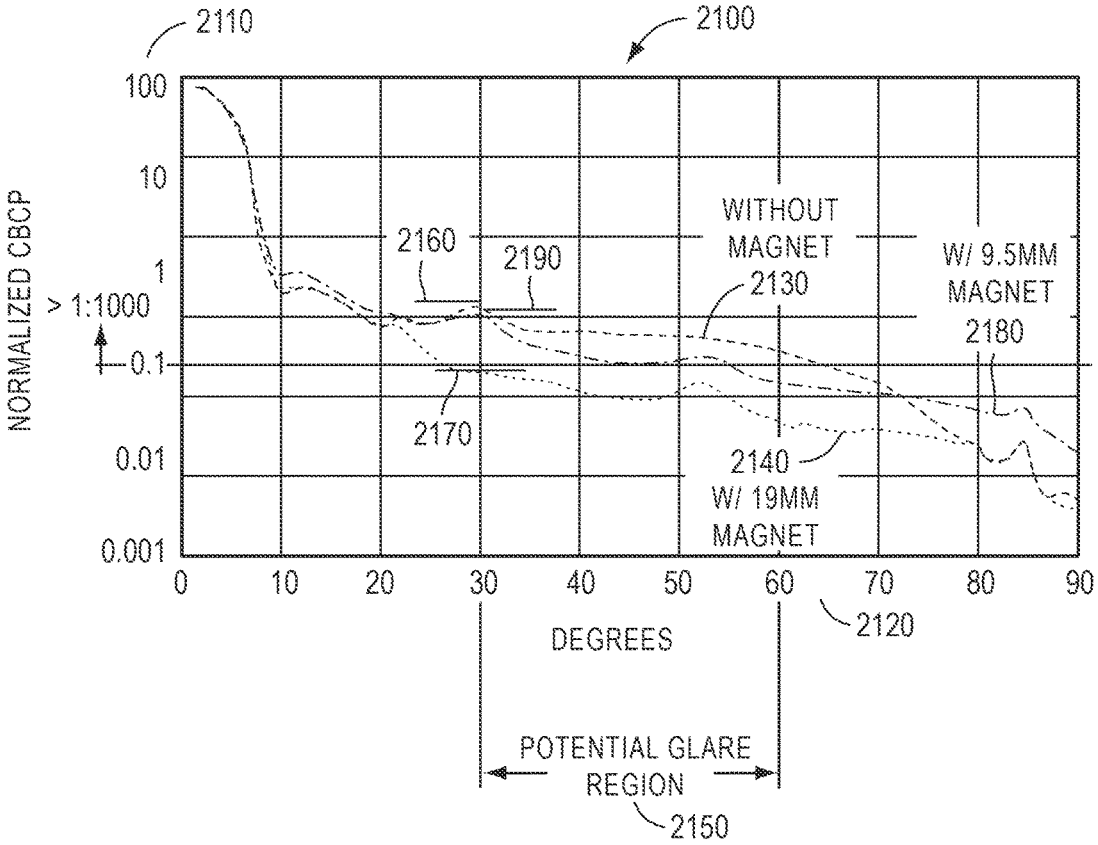
FIG. 21 is a graph showing the normalized CBCP as a function of angle for various light sources.

FIG. 21 illustrates measured results according to various embodiments of the present invention. In this example, graph 2100 represents a normalized candle power output 2110 versus angle 2120 in degrees from the optical axis. Two traces are plotted, a first plot 2130 represents an embodiment of a light source, as described above, without a glare cap, and a second plot 2140 represents the same embodiment of the light source, with a glare cap in place. As can be seen, the maximum intensity for both plots is normalized at 100, and the angle where the intensity drops to about 50% is approximately 5 degrees. Using the terminology above, the beam angle for this lens is approximately 10 degrees. Further, the angle where the intensity drops to about 10% is approximately 7 degrees. Again, using the terminology above, the field angle is approximately 14 degrees.

In FIG. 21, the glare region 2150 ranges from about 30 degrees from the optical axis to about 60 degrees (or higher, e.g., 75 degrees, 90 degrees) from the optical axis, or the like, as discussed above. A first light intensity plot 2130 and an intensity second light plot 2140 are illustrated. In this example first plot 2130 represents an 83 mm diameter lens light source not having a glare cap, and second plot 2140 represents the same 83 mm diameter lens light source with a 19 mm glare cap. As shown in FIG. 21, on plot 2130, at 30 degrees off-axis, the light intensity is approximately 0.5 (2160). Comparing this light intensity (2160) to the normalized maximum light intensity of 100, the ratio is approximately 1:200. Accordingly, because this light ratio at 30 degrees off-axis is greater than 1:1000, the light source without the glare cap produces glare at least 30 degrees. Based upon a similar analysis, the light source without the glare cap produces glare, all the way up to about 68 degrees off-axis.

In this example, as shown on plot 2140, at 30 degrees off-axis, the light intensity is approximately 0.085 (2170). Comparing this light intensity (2170) to the normalized maximum light intensity of 100, the ratio is approximately 1:1200. Accordingly, because this light ratio at 30 degrees off-axis is lower than 1:1000, the light source using the glare cap does not produce glare at least 30 degrees off-axis. Based upon a similar analysis, the light source using the glare cap does not produce glare, all the way up to 90 degrees off-axis. In this example, the ratio of the lens diameter to the glare blocker is about 4.4:1.

In this example, an additional plot 2180 is shown. In this example, a 9.5 mm glare blocker is placed upon an 83 mm diameter lens light source. As can be seen, on plot 2180, at 30 degrees off-axis, the light intensity is approximately 0.4 (2190). Comparing this light intensity (2190) to the normalized maximum light intensity of 100, the ratio is approximately 1:400. Accordingly, because this light ratio at 30 degrees off-axis is higher than 1:1000, the light source using this diameter glare cap produces glare at least 30 degrees off-axis. Based upon a similar analysis, the light source using this glare cap produces glare, all the way up to about 56 degrees off-axis. In this example, the ratio of the lens diameter to the glare blocker is about 8.8:1.

In various embodiments, glare produced from a light source may also be completely eliminated if the glare cap entirely covered the front of the lens. However, in such a case no light would be output from the light source. Accordingly, appropriate sizes for a glare cap can be selected that reduce glare, yet not decrease the maximum intensity of the light, and/or the over-all light output. Surprisingly, introduction of a glare blocker can counter-intuitively increase the center beam intensity. In particular, Table 1 provides center beam intensity for an 83 mm diameter lens having different diameter glare blockers.

TABLE 1

| Glare blocker/ magnet diameter (mm) | Center beam intensity (candle power) with a 100 LM 8.5 mm diameter light source | Lens diameter | Glare blocker:Lens diameter ratio |
|---|---|---|---|
| 0 | 2748 | 83 | n/a |
| 9.5 | 2742 | 83 | 8.736842 |
| 19 | 3097 | 83 | 4.368421 |

TABLE 1-continued

| Glare blocker/ magnet diameter (mm) | Center beam intensity (candle power) with a 100 LM 8.5 mm diameter light source | Lens diameter | Glare blocker:Lens diameter ratio |
|---|---|---|---|
| 30 | 3055 | 83 | 2.766667 |
| 40 | 2892 | 83 | 2.075 |

As demonstrated in Table 1, based upon experimental results, the center beam intensity is generally lower without a glare blocker. Further, the glare blocker diameter tested having the highest center beam intensity in this example is 19 mm. As also demonstrated in Table 1 the ratio of glare blocker to lens diameter is approximately 1:4.4 within this region. It is expected that further experimental data may show that other glare blocker diameters may provide even higher center beam intensities, e.g., 20 mm, 22 mm, 25 mm, or the like.

Figure 22:
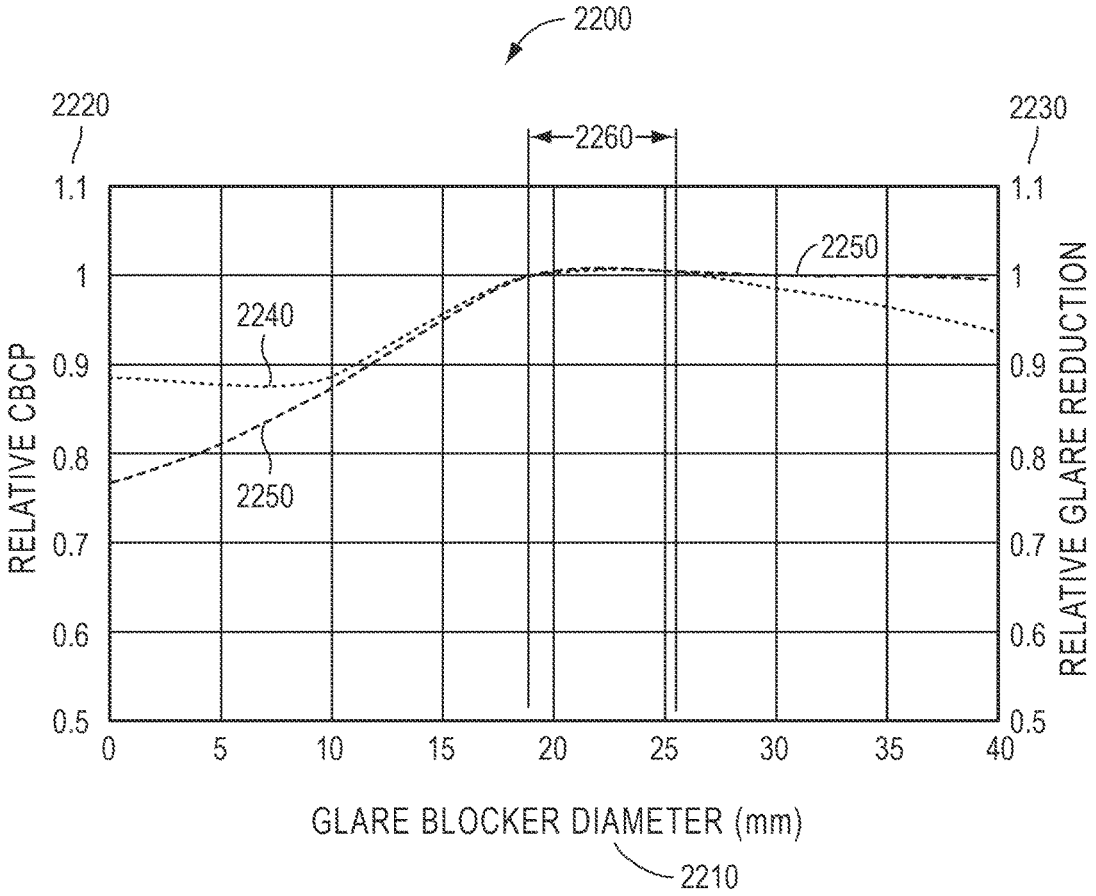
FIG. 22 is a graph showing the effect of glare blocker diameter on the relative CBCP and on the relative glare reduction according to certain embodiments.

FIG. 22 is a graph showing the effect of glare blocker diameter on relative CBCP and on relative glare reduction. More particularly, graph 2200 plots a glare blocker diameter 2210 versus relative center beam intensity (candle power) 2220 (in blue) and versus relative reduction in glare 2230 (in red). In this example, an 83 mm diameter lens was again used, for sake of convenience. As indicated, the measurements are normalized relative to a glare blocker of 40 mm, although normalization may be taken at other sizes, for sake of convenience.

In FIG. 22, plot 2240 represents a graphical representation of the data presented in Table 1. In plot 2240, the relative center beam intensity is normalized at 1 at about 19 mm, and the relative center beam intensity with no glare blocker is normalized at less than 1. In plot 2240, the highest relative intensities are examples embodiments having a glare blocker within a range of about 19 mm to about 26 mm (>1). Based upon a 83 mm lens diameter, the highest relative intensities (or maximum of beam within the center beam) are thus associated with a glare blocker to lens diameter ratio from about 1:4.5 (e.g., 1:4.4) to about 1:3 (e.g., 1:3.2).

In FIG. 22, plot 2250 represents another graphical representation of the data presented in Table 1. In plot 2240, the reduction in light intensity due to a glare blocker is normalized with respect to 40 degrees off-axis. In other embodiments, measurements may be relative to other angles, potentially leading to different results. As shown in FIG. 22, in plot 2250, the glare blockers associated with the highest attenuation of light intensity, e.g., glare is within a range of about 19 mm to about 28 mm. Based upon a 83 mm lens diameter, the highest glare attenuation at 40 degrees off-axis is associated with a glare blocker to lens diameter ratio from about 1:4.5 (e.g., 1:4.4) to about 1:3 (e.g., 1:2.9).

Based on the above experimental results, a more desirable range 2260 of glare blockers to lens diameter ratio has been determined. In certain embodiments, the optimal range surprisingly increases a maximum center beam intensity while reducing light intensity within a glare region (about 30 degrees to about 60 degrees) to less than 1:1000. In various embodiments the ratio is on the order of about 1:2.5 to about 1:5, 1:3 to about 1:4.5; about 1:2.8 to about 1:4.6; or the like.

Finally, it should be noted that there are alternative ways of implementing the embodiments disclosed herein. Accordingly, the present embodiments are to be considered as illustrative and not restrictive. Furthermore, the claims are not to be limited to the details given herein, and are entitled to their full scope and equivalents thereof.

What is claimed is:

1. A light source comprising:

a light assembly comprising a plurality of LED light sources configured to output light;

a heat sink coupled to the light assembly configured to dissipate heat generated by the light assembly;

a lens assembly configured to:

receive light from said light assembly; and emit first and second light at a plurality of angles relative to a central geometric axis of said plurality of LED light sources, wherein said first light is emitted at angles in a range of 0-30 degrees and has a first maximum intensity, and said second light is emitted at angles above 30 degrees has a second maximum intensity, and a glare reduction element disposed relative to said light assembly such that at least a portion of said light from said light assembly is incident upon said glare reduction element to restrict said second maximum intensity such that the ratio of said second maximum intensity to said first maximum intensity is less than 1:1000.

2. The light source of claim 1, wherein the ratio of the first maximum intensity to the second maximum intensity is within a range from about 1:1000 to about 1:5000.

3. The light source of claim 1, wherein the second angle is within a range from about 30 degrees to about 45 degrees relative to the central geometric axis.

4. The light source of claim 1, wherein the lens assembly comprises a lens characterized by a first diameter, wherein the glare reduction element is characterized by a second diameter; and wherein a ratio between the second diameter and the first diameter is within a range from about 1:2.5 to about 1:4.5.

5. The light source of claim 4, wherein, the ratio between the second diameter and the first diameter is within a range of about 1:2.7 to about 1:4.3; and the maximum beam intensity is within a range from about 3000 candle power to about 3100 candle power for a source scaled to 100 lumens.

6. The light source of claim 1, wherein the lens assembly comprises a lens characterized by a diameter and a height, wherein a ratio between the diameter and the height is within a range from about 5:1 to about 7:1.

7. The light source of claim 1, wherein said a glare reduction element is a discrete element.

8. The light source of claim 7, wherein said glare reduction element is disposed on said lens assembly such that said central geometric axis passes through said glare reduction element.

9. The light source of claim 4, wherein said glare reduction element is disposed on said lens assembly such that said central geometric axis passes through said glare reduction element.

10. The light source of claim 1, wherein said glare reduction element is a magnet or magnetic.

* * * * *